US006470167B2

(12) United States Patent
Hwang

(10) Patent No.: US 6,470,167 B2
(45) Date of Patent: Oct. 22, 2002

(54) HEATING ROLLER FOR FIXING A TONER IMAGE AND METHOD OF MANUFACTURING THE SAME

(75) Inventor: Tae-Heum Hwang, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/739,454

(22) Filed: Dec. 19, 2000

(65) Prior Publication Data

US 2001/0024582 A1 Sep. 27, 2001

(30) Foreign Application Priority Data

Feb. 24, 2000 (KR) ..... 2000-9177
Sep. 2, 2000 (KR) ..... 2000-51885

(51) Int. Cl.[7] ..... G03G 15/20
(52) U.S. Cl. ..... 399/333; 219/216
(58) Field of Search ..... 219/216, 388, 219/469; 399/320, 330, 333; 29/895

(56) References Cited

U.S. PATENT DOCUMENTS

| | | | | |
|---|---|---|---|---|
| 4,060,663 A | | 11/1977 | Merz et al. | |
| 4,299,887 A | | 11/1981 | Howell | |
| 4,395,109 A | * | 7/1983 | Nakajima et al. | 219/216 |
| 4,724,305 A | | 2/1988 | Iimura et al. | |
| 4,776,070 A | | 10/1988 | Shibata et al. | |
| 5,069,824 A | | 12/1991 | Blanke et al. | |
| 5,083,168 A | | 1/1992 | Kusaka et al. | |
| 5,250,958 A | | 10/1993 | Yoshida et al. | |
| 5,264,156 A | | 11/1993 | Gora et al. | |
| 5,463,367 A | | 10/1995 | Ellis | |
| 5,624,782 A | | 4/1997 | Hayakawa et al. | |
| 5,854,465 A | * | 12/1998 | Kishi et al. | 219/216 |
| 5,900,295 A | | 5/1999 | Kawada | |
| 5,966,067 A | | 10/1999 | Murakami et al. | |
| 6,023,217 A | | 2/2000 | Yamada et al. | |
| 6,035,155 A | * | 3/2000 | Kaji et al. | 399/33 |
| 6,223,017 B1 | * | 4/2001 | Akutsu et al. | 219/216 |
| 6,329,639 B1 | * | 12/2001 | Akutsu et al. | 219/216 |

FOREIGN PATENT DOCUMENTS

| | | |
|---|---|---|
| JP | 2-110903 | 4/1990 |
| JP | 3-52202 | 3/1991 |
| WO | WO93 23855 | 11/1993 |

* cited by examiner

*Primary Examiner*—Robert Beatty
(74) *Attorney, Agent, or Firm*—Robert E. Bushnell, Esq.

(57) ABSTRACT

A heating roller for use in fixing a toner in an electrophotographic process and the method of making the heating roller are described. In one embodiment, the heating roller includes a roller body having a cylindrical outer surface, a heat-generating layer formed on the roller body, electrodes on axial ends of the heat-generating layer, and a protection layer on the heat-generating layer. Another embodiment includes an electrically insulating layer between the roller body and the cylindrical outer surface. The heat generating layer is formed by heat-treating a paste made which contains ruthenium and lead or ruthenium and silver. The paste may be made from a ruthenium compound, a glass frit containing lead, an organic binder and an organic solvent, as well as other components.

92 Claims, 19 Drawing Sheets

HEATING ROLLER FOR FIXING A TONER IMAGE AND METHOD OF MANUFACTURING THE SAME

CLAIM OF PRIORITY

This application makes reference to, incorporates the same herein, and claims all benefits accruing under 35 U.S.C. §119 from an application for DIRECTLY HEATING ROLLER FOR FIXING A TONER IMAGE AND MANUFACTURING METHOD THEREOF earlier filed in the Korean Industrial Property Office on Feb. 24, 2000 and on Sep. 2, 2000, and there duly assigned Ser. No. 9177/2000 and No. 51885/2000 respectively.

BACKGROUND OF THE INVENTION

1. Field of the Invention

The present invention relates to a directly heating roller for fixing a toner image and manufacturing method thereof 2. Description of the Related Art In conventional electrophotographic copying machines, facsimiles, printers and related machines using an electrophotographic process, a charging roller uniformly charges a photoreceptor on an outer circumference of a photoreceptor drum by applying a high voltage when the charging roller is rotated. An electrostatic latent image is formed on the drum by scanning the surface of the photoreceptor through a laser scanning unit (LSU). Then, a visual image is developed through a developer by supplying a toner to the electrostatic latent image formed on the photoreceptor. Thereafter, an image formed by the toner is copied on a paper that passes between a copying roller and the photoreceptor drum by applying a copying voltage and by rotating them.

In order to fix the toner image, a conventional electrophotographic image forming apparatus uses a method of temporarily melting accumulated toner using a heating roller in a fixing portion of the image forming apparatus to apply heat to the paper. Generally, as a heat source of heating the heating roller at a predetermined temperature, a halogen lamp is installed in the heating roller.

A conventional electrophotographic image forming apparatus includes a paper outlet, a control panel, a control board cover, an upper cover opening button, a paper displaying window, a multipurpose paper feeding window, an auxiliary cassette, a paper cassette and a subsidiary support.

In operation of the apparatus, a toner is stirred by a stirrer in a toner cartridge. A toner-regulating blade regulates the amount of toner supplied and thus the toner is supplied through a supply roller. A charging roller uniformly charges a charge layer on the surface of a photoreceptor drum. A laser scanning unit forms a electrostatic latent image on the surface of the photoreceptor drum. A developing roller develops the toner on the electrostatic latent image formed on the surface of the photoreceptor drum. A copying roller copies a toner image formed on the surface of the photoreceptor drum onto a paper.

Thereafter, the paper on which the toner is attached is sent to a fixing portion, and when the paper passes between a heating roller and a pressure roller, the toner image in the form of a powder is melted and is fixed on the paper. In other words, the heating roller generates a heat when a voltage is applied to the halogen lamp. The toner is melted due to a fixing heat of the fixing roller and is fixed on the paper a pressure of the pressure roller. A thermistor located on the heating roller serves to maintain a constant temperature by sensing the temperature of the fixing roller.

The technology using a halogen lamp has a disadvantage that power consumption is high. One reason for the high power consumption is that this device requires a predetermined warming-up time when electrical power is supplied to form an image at a time after the electrophotographic image forming apparatus has been turned off. The predetermined time, which may range from tens of seconds to tens of minutes, must elapse after the start of supplying electrical power before the heating roller reaches a desired target fixing temperature. The conventional technology described above also requires that electrical power be applied even in a standby mode in order to maintain a constant roller temperature, which further increases the power consumption.

Another disadvantage is that it is very difficult to compensate for the decrease of the roller temperature due to heat loss to the paper which occurs when the heating roller contacts the paper. Furthermore, in order to print the next image, a predetermined standby time should be passed and, therefore an image can not be rapidly printed.

A different kind of heating roller of the conventional art, a directly-heating roller for fixing a toner image, is described in U.S. Pat. No. 4,776,070. This directly heating roller has a bonding layer deposited on a roller body, and a lower insulating layer deposited on the bonding layer. The lower insulating layer provides electrical insulation between the roller body and the layers above. A heat generating resistance layer is arranged on the lower insulating layer, and an upper insulating layer is arranged on the heat generating resistance layer. A protective layer is arranged on the upper insulating layer and serves to prevent an offset of the toner image from occurring. Electrode layers are arranged on axial end portions of the heat generating resistance layer and serve to provide electrical power to the heat generating resistance layer.

The heat generating resistance layer is described as made of a Ni—Cr compound and a ceramic matrix formed from an alumina ceramic, and an arc-plasma spraying method is used to construct the heat generating layer. The bonding layer is described as a Ni—Cr—Mo, Ni—Al or Ni—Cr alloy which is plasma-sprayed so as to partially form an oxide.

This bonding layer is apparently required in order to bond the roller body to ceramic used in the lower insulating layer. However, even with the bonding layer, a separation between the layers may occur due to temperature characteristics between the two layers, or from applied pressure.

Based on my reading of the art, then, I have decided that what is needed is a better directly heating roller for use in electrophotographic devices.

SUMMARY OF THE INVENTION

It is therefore an object of the present invention to provide a directly heating roller for fixing a toner image and a method of manufacturing the same.

It is also an object of the invention to provide a directly heating roller have a short warming-up time, a low power consumption and a simple structure.

It is a further object to provide a directly heating roller which has excellent heat resistance and durability.

A yet further object of the invention is to provide a directly heating roller which does not suffer from separation between the roller body and an insulation layer on the roller.

A still further object of the invention is to provide a directly heating roller which is less expensive to manufacture.

In order to achieve the above objects, the present invention provides a directly heating roller for fixing a toner image, including a conductive roller body having a cylindrical cross section; an insulating layer formed by a heat-treatment at a first temperature less than an elastic critical temperature of the roller body; a heat generating layer formed on the insulating layer by a heat-treatment at a second temperature less than the first temperature; a protection layer formed on the heat generating layer; and electrodes formed on both end portions of the heat generating layer.

The present invention further provides a method of manufacturing a directly heating roller for fixing a toner image including preparing a conductive roller body having a cylindrical cross section; depositing an insulating layer paste on an outer surface of the roller body in a predetermined thickness; forming an insulating layer by heating the insulating layer paste at a first temperature of less than an elastic limit temperature of the conductive cylindrical roller; depositing a heat generating layer paste on the surface of the insulating; forming a heat generating layer by heating the heat generating layer paste at a second temperature of less than the first temperature; forming a protection layer on the heat generating layer; and forming electrodes on both sides of the heat generating layer.

The present invention further provides a directly heating roller for fixing a toner image, including: an insulating roller body having a cylindrical cross section; a heat generating layer formed by depositing the heat generating layer paste on the roller body in the form of a paste and by heating the deposited heat generating layer paste at a temperature of less than the elastic critical temperature of the roller body; a protection layer formed on the heat generating layer; and electrodes electrically contacting to both end portions of the heat generating layer.

The present invention provides a method of manufacturing a directly heating roller for fixing a toner image, including: preparing an insulating roller body having a cylindrical cross section; depositing a heat generating layer paste on the surface of the roller body in a uniform thickness; forming a heat generating layer by heat-treating the heat generating layer paste at a predetermined temperature; forming a protection layer on the heat generating layer; and forming electrodes on both ends of the heat generating layer.

As described herein before, according to the embodiments of the present invention, it is possible to form a ruthenium-based heat generating layer on the surface of the roller and to make it to instantaneously reach a fixing temperature. As compared with the Ni—Cr based resistive heat generating material according to the conventional art, it is possible to generate a target fixing temperature as soon as possible using a lower electrical power. Also, in forming a ruthenium-based electric resistance heat generating layer, since a process can be carried out at a temperature below 700° C., below 600° C., or even below 550° C., and thus a wide range of materials may be selected for the roller body and the insulating layer. Accordingly, the manufacturing yields can be improved and cost can be reduced. Further, it is possible to manufacture a heat generating resistor layer having a uniform thickness. Furthermore, since it is possible to maintain the fixing temperature characteristics uniformly as a whole, and thus the toner fixing characteristics can be improved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
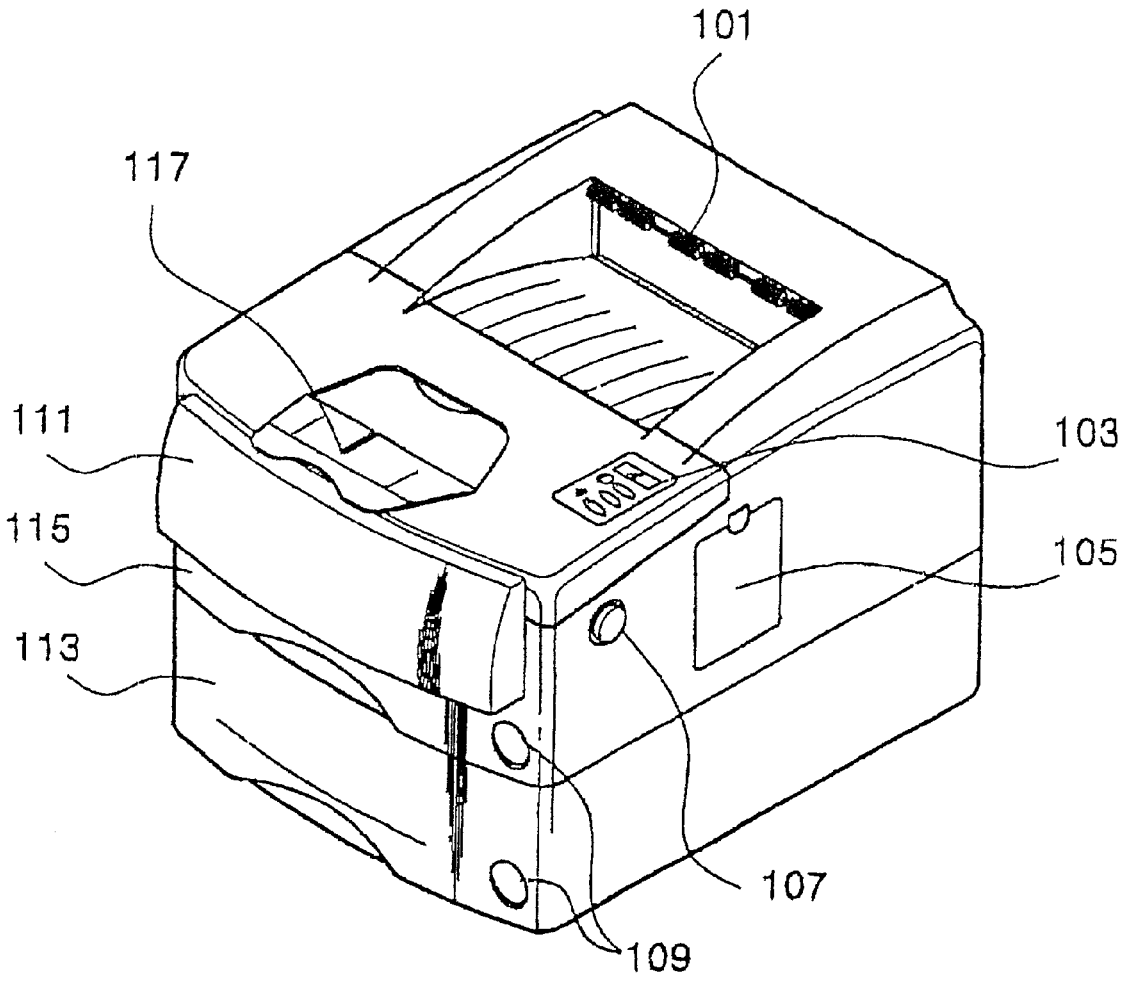
FIG. 1 is a perspective view illustrating a conventional electrophotographic image forming apparatus.

Turning now to the drawings, FIG. 1 shows the conventional electrophotographic image forming apparatus discussed above. As shown in FIG. 1, the conventional electrophotographic image forming apparatus includes a paper outlet 101, a control panel 103, a control board cover 105, an upper cover opening button 107, a paper displaying window 109, a multipurpose paper feeding window 111, an auxiliary cassette 113, a paper cassette 115 and a subsidiary support 117.

Figure 2:
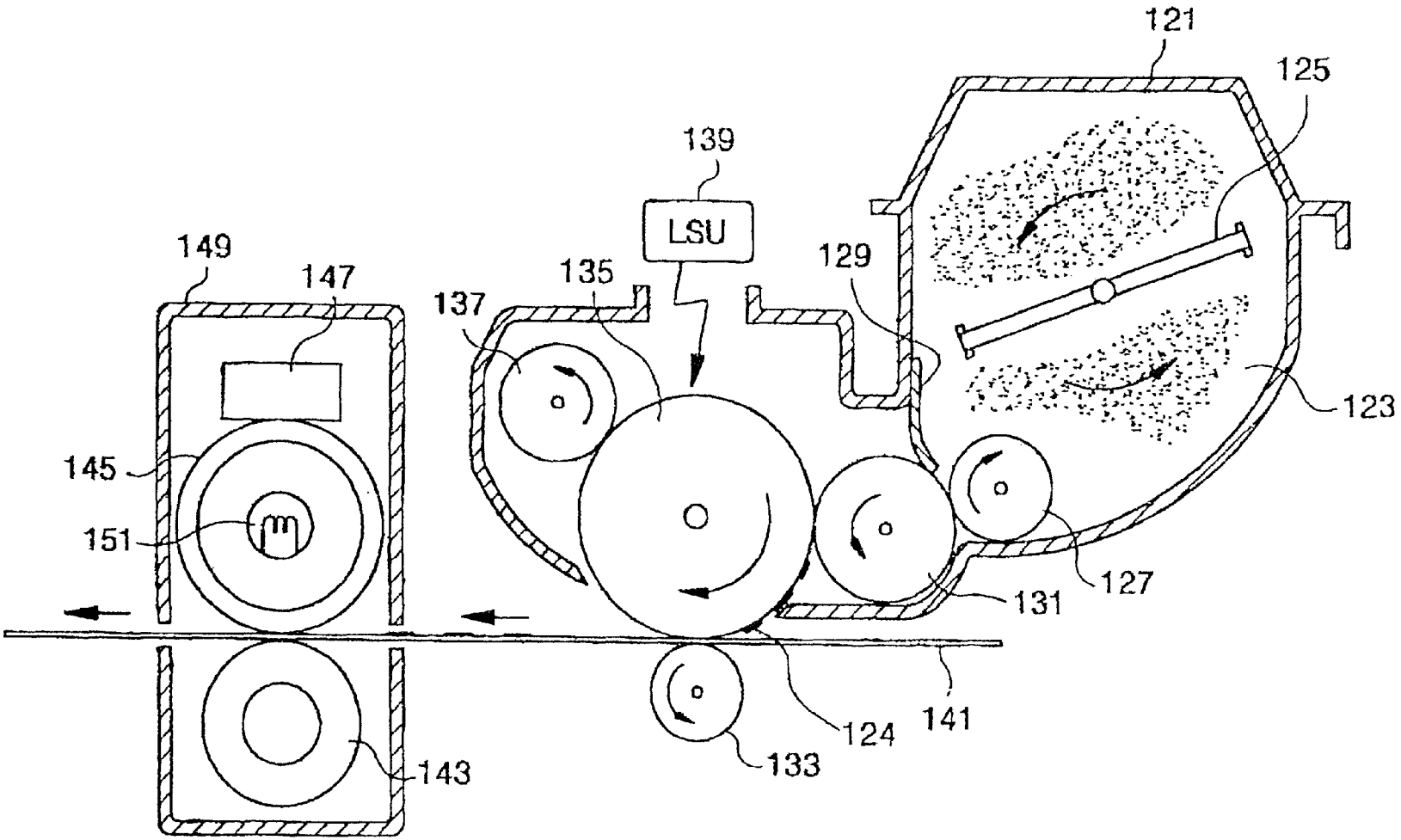
FIG. 2 is a schematic view showing an internal configuration of the conventional electrophotographic image forming apparatus.
Figure 3:
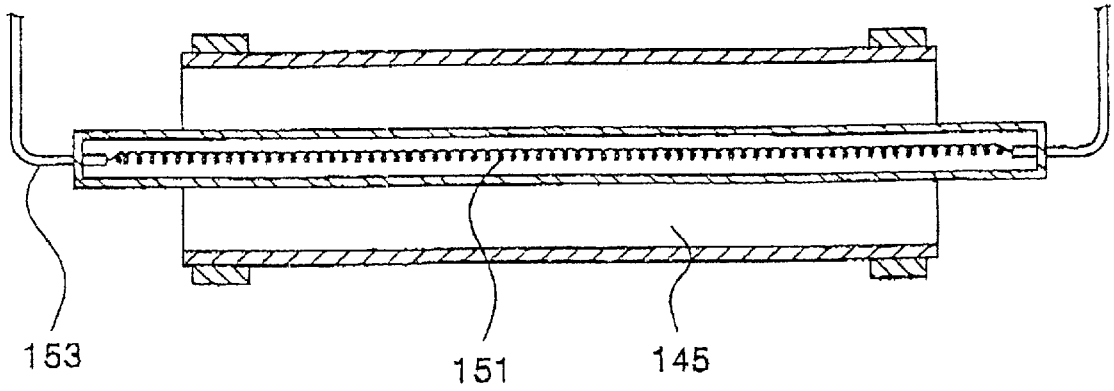
FIG. 3 is a cross-sectional view showing a halogen lamp heating roller installed in the conventional electrophotographic image forming apparatus.

FIG. 2 shows an internal configuration of the conventional electrophotographic image forming apparatus, and FIG. 3 shows the arrangement of a halogen lamp heating roller installed in the conventional electrophotographic image forming apparatus. In operation of the apparatus shown in FIGS. 2 and 3, a toner 123 is stirred by a stirrer 125 in a toner cartridge 121. A toner-regulating blade 129 regulates the amount of toner supplied and thus the toner 123 is supplied through a supply roller 127. A charging roller 137 uniformly charges a charge layer on the surface of a photoreceptor drum 135. A laser scanning unit 139 forms a electrostatic latent image on the surface of the photoreceptor drum 135. A developing roller 131 develops the toner 123 on the electrostatic latent image formed on the surface of the photoreceptor drum 135. A copying roller 133 copies a toner image 124 formed on the surface of the photoreceptor drum 135 onto a paper 141.

Thereafter, the paper 141 on which the toner is attached is sent to a fixing portion 149, and when the paper passes between a heating roller 145 and a pressure roller 143, the toner image in the form of a powder is melted and is fixed on the paper. In other words, the heating roller 145 generates a heat when a voltage is applied to the halogen lamp 151. The toner is melted due to a fixing heat of the fixing roller 145 and is fixed on the paper a pressure of the pressure roller 143. A thermistor 147 located on the heating roller 145 serves to maintain a constant temperature by sensing the temperature of the fixing roller 145.

Figure 4:
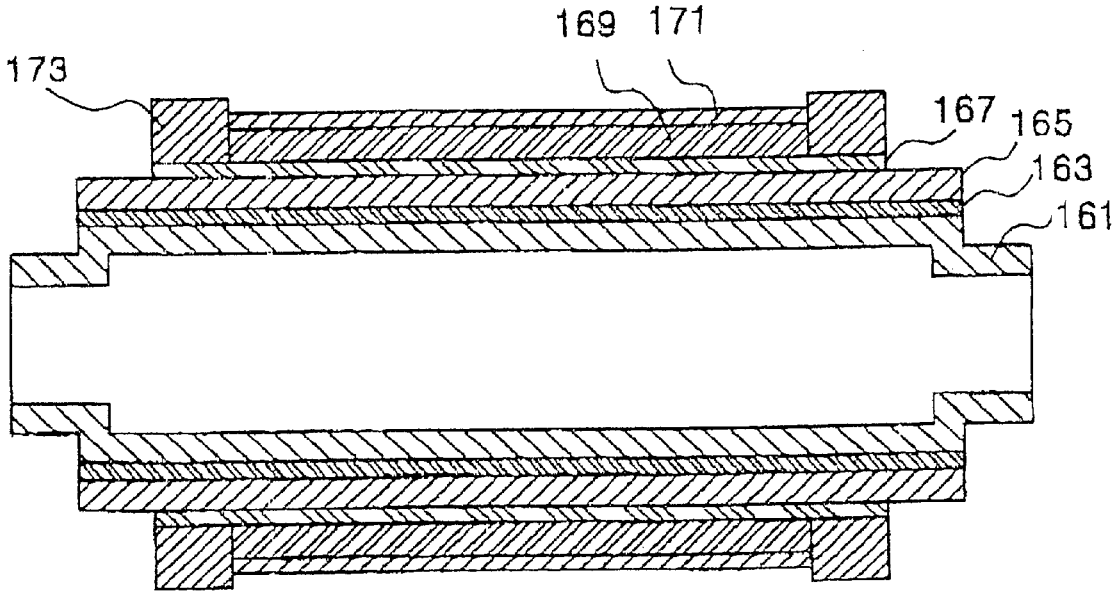
FIG. 4 is a cross-sectional view showing a directly heating roller for fixing a toner image is installed in the conventional electrophotographic image forming apparatus.

The directly-heating roller for fixing a toner image, discussed above, is illustrated in FIG. 4. Referring to FIG. 4, the directly heating roller has a bonding layer 163 deposited on a roller body 161, and a lower insulating layer 165 deposited on the bonding layer. The lower insulating layer 165 provides electrical insulation between the roller body and the layers above. A heat generating resistance layer 167 is arranged on the lower insulating layer 165, and an upper insulating layer 169 is arranged on the heat generating resistance layer 167. A protective layer 171 is arranged on the upper insulating layer and serves to prevent an offset of the toner image from occurring. Electrode layers 173 are arranged on axial end portions of the heat generating resistance layer and serve to provide electrical power to the heat generating resistance layer.

The present invention will hereinafter be described in detail through embodiments of the present invention, with reference to the accompanying drawings.

First Structural Embodiment

Figure 5:
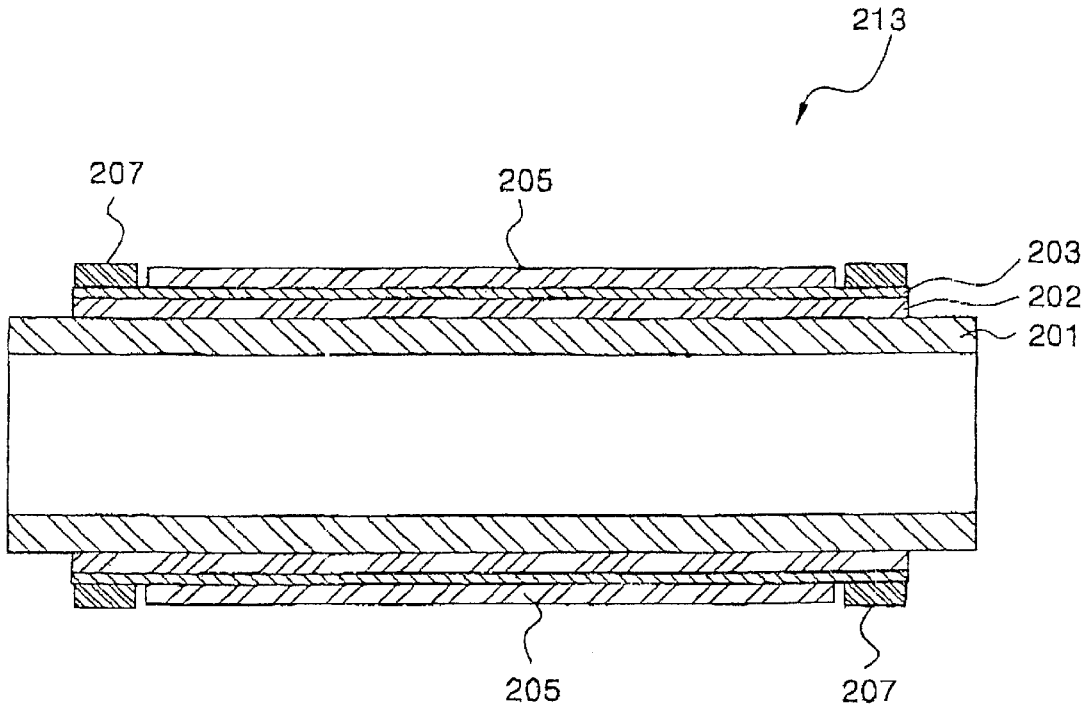
FIG. 5 is a cross-sectional view showing a directly heating roller of an electrophotographic image forming apparatus according to a first structural embodiment of the present invention.

FIG. 5 is a cross-sectional view showing a directly heating roller of an electrophotographic image forming apparatus according a first structural embodiment of the present invention. As shown in FIG. 5, the directly heating roller 213 includes an electrically insulating layer 202, a heat generating resistor layer 203 and a protection layer 205, which are sequentially stacked on a roller body 201. As shown, the roller body is generally cylindrical in shape where the insulating layer covers the roller body. The roller body may be a hollow cylinder, or tube, as illustrated. A central portion of the heat generating layer 203, that is, the portion between and not including the axial end portions of the heat generating layer, is protected by the protection layer, and an electrical current is supplied to the heat generating layer 203 through a pair of electrodes 207 arranged with one electrode on each end portion of the heat generating layer 203.

Figure 6:
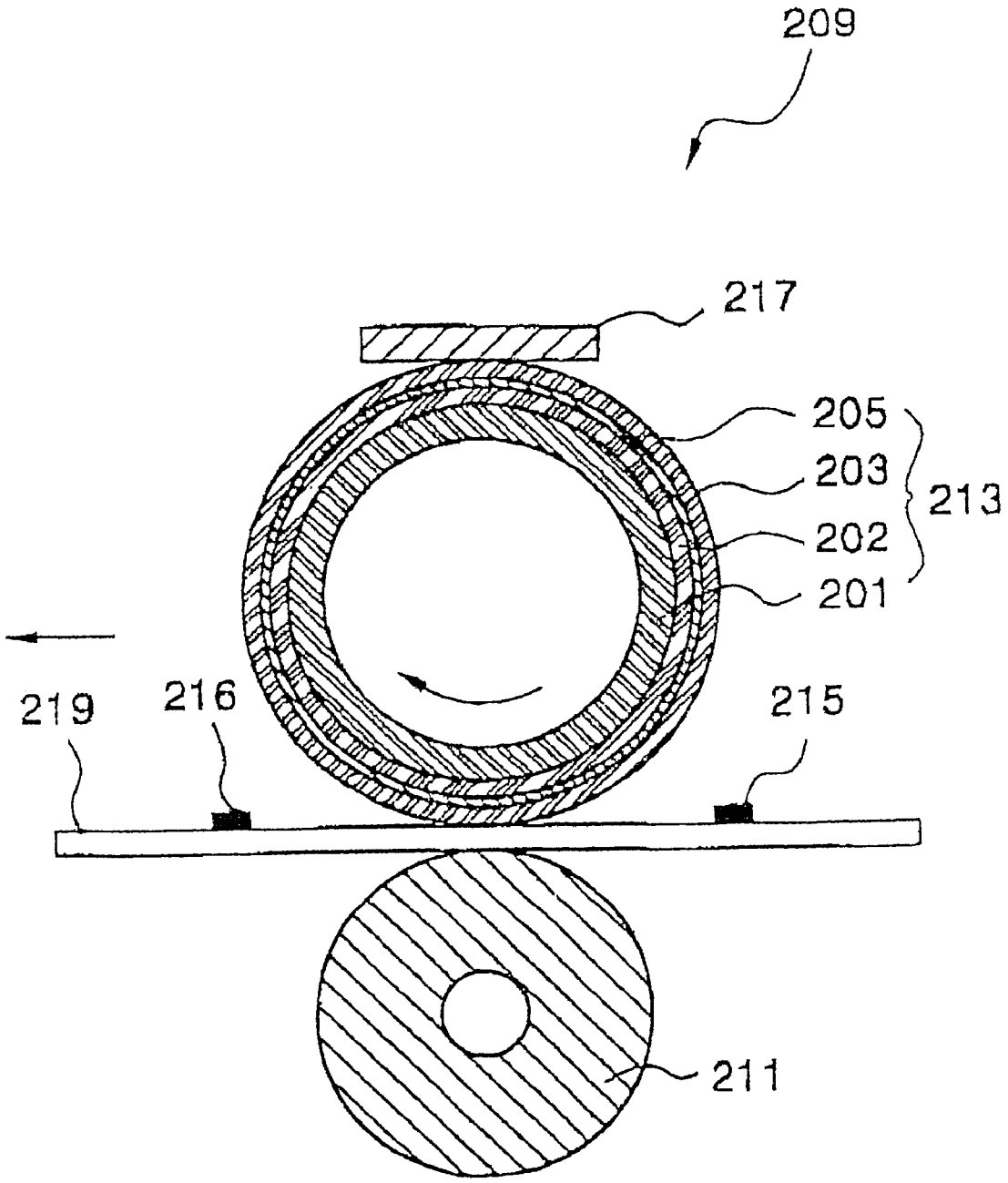
FIG. 6 is a cross-sectional view showing a fixing part of an electrophotographic image forming apparatus installed with a heating roller according to the first structural embodiment of the present invention.

FIG. 6 is a cross-sectional view showing a fixing portion of an electrophotographic image forming apparatus using the heating roller of FIG. 5. As shown in FIG. 6, the fixing portion of the electrophotographic image forming apparatus includes a heating roller 213 that rotates in a direction corresponding to the movement of the paper 219, i.e., in a clockwise direction as shown in the figure, and a pressure roller 211 that rotates in a counterclockwise direction. A thermistor or temperature sensor 217 for detecting a temperature of the heating roller 213 is arranged on the heating roller 213.

The heating roller 213 and the pressure roller 211 are arranged to rotate centering on the body of the image forming apparatus. The installed heating roller 213 and the pressure roller 211 are rotated by an electric driving motor (not shown in FIG. 6) arranged in the body of the image forming apparatus. The heating roller 213 generates resistive heat due to an electrical current supplied to the heat generating layer 203 when electrical power is applied through the electrodes 207, thereby increasing the temperature of the heating roller. The surface temperature of the heating roller 213 is detected by the thermistor 217 contacting the surface of the heating roller 213 and the temperature information is provided to an electrical power supply controller (not shown) in the body of the image forming apparatus. The power supply controller controls the surface temperature of the heating roller 213 to be within a set heating temperature range. Unfixed toner image 215 on paper 219 is heated and pressed by the heating roller 213 and the pressure roller 211 leading to a stable toner image 216. Therefore, the heating roller according to the first embodiment of the present invention can reduce power consumption by reducing the warming-up time.

The heating roller of the first structural embodiment, illustrated in FIG. 5, may be realized with a variety of materials and processes of making to be described below. In particular, the first material and process embodiment to be described below includes an austenite-based stainless steel roller body, and the second material and process embodiment includes a Ferrite-based stainless steel roller body.

First Material and Process Embodiment

1. Roller Body

A body 201 of a heating roller 213 is made of austenite-based stainless steel, for example, SUS304 series, JIS standard, or the like. The austenite-based stainless steel may have a temperature process limitation in subsequent processes that is limited to be below 630° C. because the mechanical characteristics may change. For example, if a temperature exceeds the elastic critical temperature, i.e., 630° C., the austenite-based stainless steel may be deformed or twisted.

The elastic critical temperature is defined as follows. A substance is deformed when it receives a load. Thereafter, if the load is removed, the substance is restored to an original shape. An elastic limit is defined as the limiting load whereby a substance is restored to an original shape after a load is removed.

Here, the elastic critical temperature is the highest temperature where a conductive cylindrical roller body can maintain shape without losing the original shape in a process by heat, in particular in the heat-treatment of a paste on the cylindrical roller body which will become the insulating layer or heat generating layer. In general, when the cylindrical roller body is heated over the elastic critical temperature, the roller body may be twisted or bent, whereupon the elastic-deformed roller can not perform a toner image fixing at a temperature by uniformly cohering the toner image on the paper uniformly.

2. Insulating Layer

An electrically insulating layer 202 is formed by depositing a paste, which is made by mixing a glass frit, an organic binder, a solvent and an additive, on a roller body 201 using a thick film deposition method and then by heating the paste below the elastic critical temperature of the roller body 201 of about 630° C. The insulating layer has a uniform thickness of about 50–300 micrometers. The glass frit has the following general composition ratio:

| | |
|---|---|
| PbO | 40–60 wt % |
| $SiO_2$ | 20–40 wt % |
| $B_2O_3$ | 10–20 wt % |
| $Al_2O_3$ | 0–10 wt % |
| $TiO_2$ | 0–5 wt % |

It is more preferable that the glass frit consists of PbO 55.9%, $SiO_2$ 28.9%, $B_2$ $O_3$ 8.1%, $Al_2O_3$ 3 4.7% and $TiO_2$ 3.3%. The organic binder is made of a cellulose-based resin, an acryloyl-based resin, or the like. Terpineol, BCR, BCA, or the like is used as a solvent, and $Al_2O_3$, $ZrO_3$, or the like may be added as thixotropic agents.

3. Heat Generating Resistor Layer

The heat generating resistor layer 203 is formed by making a paste by mixing a powdered ruthenium-based compound, a powdered silver compound, a glass frit containing PbO, an organic binder, a solvent and an additive, and then by depositing the paste on an insulating layer 202 using a thick film deposition method and by heating the deposited paste at about 550° C.

The ruthenium-based powder and Ag-based powder used as a conductive material in a heat generating layer paste of the present invention influence the electrical characteristics and the mechanical characteristics of a final thick film. The glass frit serves to increase the bonding property of the thick film with respect to a substrate, and the organic binder serves to disperse the conductive material and an inorganic bonding agent and affects the flow properties of paste in forming the thick film.

The components used in the paste composite for the heat-generating resistorlayer are described below.

(1) Ruthenium-based Powder

The Ruthenium-based powder for use in a resistive paste composite for heat generating material of the present invention is a ruthenium-based metallic powder or a ruthenium oxide powder. A variety of compounds having the element ruthenium may be used. Compounds which may be used for the ruthenium oxide powder include $RuO_2$, $GdBiRu_2O_{6-7}$, $Co_2Ru_2O_6$, $PbBiRu_2O_{6-7}$, $Cu_xBi_{2-x}Ru_2O_{6-7}$ where $0<x<1$, and $Bi_2Ru_2O_{6-7}$. At least one of these may be selected for use. Here, the subscripts "x" and "2-x" indicate subscript ranges based on the variable x, and "6–7" indicates a range from 6 to 7. That is, the compound can be any of a series of compounds having that range of elemental ratios. The ratio surface area is referred to as surface area per weight.

It is desirable that the ratio surface area of the ruthenium-based powder is in the range of about 5 $m^2/g$ to about 30 $m^2/g$, and more desirably in the range of about 10 $m^2/g$ to about 25 $m^2/g$. If the ratio surface area is below about 5 $m^2/g$, the particles are too large to obtain a uniform thick film. If the ratio surface area is above about 30 $m^2/g$, the powder is so fine that the printing characteristics is lowered, and the degree of precision is lowered, whereby the sintering property is lowered and it is difficult to obtain a fine film.

It is desirable that the average particle diameter of the ruthenium-based powder is in the range of about 0.01 $\mu$m to about 0.1 $\mu$m, and more desirably in the range of about 0.02 $\mu$m to about 0.08 $\mu$m. If the average particle diameter is below about 0.01 $\mu$m, the particles are so fine that the printing characteristics are lowered and the degree of precision is lowered, whereby the sintering property is lowered and it is difficult to obtain a fine film. If the average particle diameter is above about 0.1 $\mu$m, the particles are too large to obtain a uniform thick film.

The amount of the ruthenium-based powder used is in the range of about 5 wt % to about 75 wt % of the composite weight, and it is desirable to be in the range of about 5 wt % to about 20 wt %. If it is below about 5 wt %, it is difficult for the formed electric resistive heat generating layer to have a low resistance in the range of about 0.1 to about 30 W. If it is over about 75 wt %, the surface smoothness of the film is lowered and is undesirable.

(2) Ag-based Powder

The resistive paste composite for heat generating material includes a Ag-based powder in the range of about 5 wt % to about 75 wt %, desirably in the range of about 20 wt % to about 40 wt %. If the Ag-based powder is present below about 5 wt %, it is difficult for the formed electric heat generating material to have a low resistance in the range of about 0.1 W to about 30 W, and if the amount exceeds about 75 wt %, the resistance value is below about 0.1 W and the heat is generated over 300° C. and a resistor thick film may be damaged.

The Ag-based powder used in the present invention may be Ag metallic powder, Ag oxide powder, for example, $Ag_2O$, Ag alloy powder, for example, AgPd and $Ag_{0.1}Pd_{0.9}RhO_2$. The Ag-based power may have a shape of a plate or a sheet. In the Ag-based powder, it is desirable that the average particle diameter is in the range of about 0.1 to about 3 $\mu$m and the maximum particle size is below about 7 $\mu$m. If the average particle diameter is below about 0.1 $\mu$m, the particles are so large that the shrinking rate is increased during sintering and the film is liable to be cracked, the particles are liable to be condensed, it is difficult to obtain a stable dispersion state among paste and the printing characteristics are lowered. If the average particle diameter is above about 3 $\mu$m, the surface of the paste deposition film becomes rough and it is difficult to obtain a fine pattern and also the sintering property is lowered and thus it is difficult to obtain a dense pattern.

It is desirable that the surface area/weight ratio, ratio surface area, of the Ag-based powder is in the range of about 0.5 to about 3.5 $m^2/g$, and the density is in the range of about 2.5 to about 6 $g/cm^3$. If the ratio surface area is below about 0.5 $m^2/g$, the particles are so large that the smoothness of a deposited film after heating is lowered, and if the ratio surface area is over about 3.5 $m^2/g$, the particle is so fine that the particle is liable to be condensed and the printing characteristics is lowered. Also, if the density is out of the range, the printing characteristics is lowered.

(3) Glass Frit

The glass frit used in the paste composite of the present invention plays a role of bonding the ruthenium-based powder particles with each other, and improves adhesion between the paste and the substrate. At the same time, the glass frit works to condense the glass frit to the substrate by softening during sintering.

The softening point of the glass frit is measured as the Littleton temperature by differential scanning calorimetry (DSC), and is desirably in the range of about 400 to about 550° C., and more desirably in the range of about 420 to about 500° C. If the softening point is below about 400° C., an organic component is liable to be contained, and blister is liable to be created among the deposited film of the paste according as the organic component is dissolved. On the other hand, if the softening point is over about 550° C., the adhesion strength of the film after sintering as to the substrate is lowered.

As the glass frit, a mixture of glass frit A and glass frit B, described generally in Table 3, may be used. As the glass frit A, a glass frit containing $Bi_2O_3$ may be used, and it is desirable to contain more than about 90 wt % of the composition like in a table 3 where the composite component and the content shown as oxide conversion marking are described, and as the glass frit B, a glass frit containing PbO is used, and it is desirable to contain about 90 wt % of the composition like in a table 4 where the composite component and the content shown as oxide conversion marking are described.

TABLE 3

| Glass frit A | |
|---|---|
| Composite component | Content (Wt %) |
| $Bi_2O_3$ | 40~90 |
| $SiO_2$ | 5~30 |
| $B_2O_3$ | 5~30 |
| BaO | 2~40 |

TABLE 4

| Glass frit B | |
|---|---|
| Composite component | Content (Wt %) |
| PbO | 40~90 |
| $SiO_2$ | 10~40 |
| $B_2O_3$ | 5~30 |
| $TiO_2$ | 0~10 |
| $Al_2O_3$ | 0~20 |

By using the glass frit, it is possible to attach the paste in a temperature where the glass substrate is not affected.

In the composition of glass frit A, if $Bi_2O_3$ is less than about 40 wt %, the effect of increasing adhesion strength during attaching the paste to the glass substrate is lowered, and if it exceeds about 90 wt %, the softening point of the glass frit is so low that the mobility of the paste gets worse and the adhesion strength with the substrate is lowered. It is desirable that the content of $Bi_2O_3$ is in the range of about 50 wt % to about 80 wt %.

In the composition of glass frit A, if $SiO_2$ is below 5 wt %, the stability of the glass frit is lowered, and if $SiO_2$ is more than about 30 wt %, the heat resistant temperature is increased and it is difficult to attach on the glass substrate at a temperature below 570° C. It is desirable that $SiO_2$ is in the range of about 5 wt % to about 15 wt %.

In the composition of glass frit A, $B_2O_3$ is added to control the fixing temperature on the glass substrate so that the characteristics of adhesion and thermal expansion coefficient will be good. When $B_2O_3$ is below 5 wt %, the adhesion strength is lowered, and if $B_2O_3$ exceeds 30 wt %, the stability of the glass frit is lowered. It is desirable that $B_2O_3$ is in the range of 7 wt % to 20 wt %.

In the composition of glass frit A, if a BaO concentration of below about 2 wt % is used, it is difficult to control the fixing temperature on the glass substrate, and if the BaO concentration exceeds about 40 wt %, the stability of the glass substrate is lowered. It is desirable that BaO is in the range of about 2 wt % to about 30 wt %.

Also, in the composition of glass frit B, if the content of PbO is below about 40 wt %, the effect of increasing the adhesion strength during attaching the paste onto the glass substrate is lowered, and if the content is in excess of 90 wt %, the softening point of the glass frit is so low that a mobility of the paste gets worse and the adhesion strength with the substrate is lowered. The desirable content of PbO is in the range of about 50-about 80 wt %.

In the composition of glass frit B, if the content of $SiO_2$ is below about 10 wt %, the stability is lowered, and if $SiO_2$ exceeds about 40 wt %, the heat resistant temperature is increased and thus it is difficult to attach onto the glass substrate below 570° C. It is desirable that the content of $SiO_2$ is in the range of about 10 wt % to about 30 wt %.

In the composition of glass frit B, if the content of $B_2O_3$ is below about 5 wt %, the adhesion strength is lowered, and if exceeding about 30 wt %, the stability of the glass frit is lowered. It is desirable that the content of $B_2O_3$ is in the range of about 5 wt % to about 20 wt %.

In the composition of the glass frit B, if the content of $TiO_2$ exceeds about 10 wt %, the stability of glass frit B is lowered, and it is desirable that the content of $TiO_2$ is about 2 wt % to about 5 wt %.

In the composition of glass frit B, $Al_2O_3$ is added to increase the variation temperature of the composite and to stabilize the glass composition or the paste. And if the content of $Al_2O_3$ exceeds about 20 wt %, the heat resistant temperature is so high that it is difficult to attach on the glass substrate. The desirable content is in the range of about 2-about 15 wt %.

Also, according to the present invention, a compound glass frit containing both glass frit A and glass frit B can be used as a glass frit, and it is desirable to contain over about 90 wt % of the compound glass frit as in table 5 where the composition component and the content shown in oxide conversion marking are described.

It is desirable that in the glass frit A, glass frit B and compound glass frit, the average particle diameter is about 0.2 $\mu$m to about 5 $\mu$m and the maximum size is below about 10 $\mu$m. If the particle diameter of the glass frit is within the range, the adhesion strength with the glass substrate at low temperature is increased and a dense film with a low resistance can be obtained, and also, in case of a thin film, delamination of the thin film does not tend to occur.

TABLE 5

| Compound glass frit | |
|---|---|
| COMPOSITION COMPONENT | CONTENT (WT %) |
| $Bi_2O_3$ | 40–90 |
| PbO | 40–90 |
| $SiO_2$ | 5–30 |
| $B_2O_3$ | 5–30 |
| BaO | 2–40 |

TABLE 5-continued

| Compound glass frit | |
|---|---|
| COMPOSITION COMPONENT | CONTENT (WT %) |
| $TiO_2$ | 0–10 |
| $Al_2O_3$ | 0–20 |

(4) Organic Binder

As an organic binder component usable in a resistive paste composite for heat generating material of the present invention, cellulose derivatives such as ethylcellulose, methylcellulose, nitrocellulose and carboxymethylcellulose, and resin components such as acrylic ester, methacrylic ester, polyvinyl alcohol and polyvinyl butyral can be used. Among these, it is desirable to use acrylic resin and ethylcellulose.

The organic binder component is used with a content of about 5 wt % to 45 wt % in the composition of the present invention, and if the content of the organic binder is not within the range, it can not be evaporated completely in the heating process for forming the heat generating layer.

(5) Organic Solvent

Also, in the composition of the present invention, an organic solvent can be added to dissolve organic components and to control the viscosity by dispersing fine powder and glass frit. As the organic solvent, there are texanol (2,2,4-trimethyl-1,3-pentandiolmonoisobutylate), ethylene glycol(terpene), butyl carbitol, ethylcellusolve, ethylbenzene, isopropylbenzene, methylethylketone, dioxane, acetone, cyclohexanone, cyclopentanone, isobutylalcohol, dimethylsulfoxide, terpineol, pine oil, polyvinylbutyral, 3-methoxybutyl acetate, γ-butyrolactone and diethylphthalate. These organic solvents can be used individually or by mixing more than two species.

(6) Other Additives

In the composition of the paste of the present invention, in addition to the above components, in order to give the stability during preservation and to prevent spreading, the saw tooth phenomenon and thickness deviation, and to prevent cracking of the film, a polymerization preventing agent such as hydroquinone monomethyl ether; a dispersant such as polyacrylate and cellulose derivative; an adhesion agent such as silane coupling agent to improve the adhesion as to the material; a defoamer to improve the deposition performance; a plasticizer such as polyethyleneglycol and diethylphthalate to improve the workability; surfactant; and an additive such as a thixotropic agent can be contained as much as not damaging the effect of the composition of the present invention within the range of 0.1 wt % to 5.0 wt %.

To make the paste composite of the present invention the constituent components are joined together using any of a variety of known mixing apparatus, for example, a a roll mill having three rolls, a mixer or a homogenizer. Also, in order to give flow properties appropriate for deposition, the viscosity of the paste composite is in the range of about 70,000 centipoise to about 300,000 centipoise at a shear rate $4S^{-1}$ in general. The viscosity of a deposition solution during printing is in the range of about 100,000 centipoise to about 200,000 centipoise, and desirably it can be controlled in the range of about 130,000 centipoise to about 180,000 centipoise.

The specific compositions of an exemplary paste for making the heat generating layer will now be described.

Exemplary paste 1. Exemplary paste 1 is made from 10 parts by weight of $Pb_2Ru_2O_6$ having an average particle diameter of 0.05 μm and surface area ratio of 10 $m^2/g$, 13 parts by weight of $RuO_2$ having an average particle diameter of 0.03 μm and surface area ratio of 23 $m^2/g$, 20 parts by weight of silver metal having an average diameter of 1 μm and maximum diameter of 3 μm, and 30 parts by weight of a glass frit having an average diameter of 1 μm and maximum diameter of 3.6 μm. The glass frit is made from 68.9% $Bi_2O_3$, 10.0% $SiO_2$, 11.8% $B_2O_3$, 6.5% BaO and 2.8% $Al_2O_3$ and has a softening point of 460° C. The above powder is mixed in a ratio of 92:8 with ethyl cellulose, and the combined powder is mixed with terpineol to yield a paste with a viscosity of 150000 centipoise.

The thickness of the heat generating layer 203 of the present invention is in the range of 3 to about 100 micrometer. The thickness of the heat generating layer 203 may be below about 15 μm, for example, 6, 8, 10 or 15 μm. The heat generating resistor layer 203 will generally be made to have an electric resistance of about 5 Ω to about 10 Ω for use with an applied voltage of a voltage of 110V, and it is desirable to have an electric resistance of about 15 W to about 25 W when a voltage of 220V is applied. These resistance values may be varied in order to have various electrical resistance values according to the requirement of a system.

4. Protection Layer

A protection layer 205 is formed on the electrical resistance heat generating layer 203 and is formed from a fluoric resin. For example, a polytetrafluoroethylene-perfluoroalkylvinyl ether copolymer resin tube is shrunk and is pressed by thermal annealing. Alternatively, the material of the protection layer can be applied by a spray process over the heat generating resistor layer. Materials suitable for the protection layer include perfluoroalkylvinyl ether resin (PFA), polytetrafluoroethylene (PTFE) and polytetrafluoroethylene-perfluoroalkylvinyl ether copolymer resin. The protection layer 205 forms a toner delaminating layer by contacting with a printing paper directly. Also, the protection layer 205 has an electrical insulating property to prevent a current from flowing from the heat generating layer to an external location.

5. Electrode

In order to form electrodes 207, a silver paste is deposited on both axial ends of the heat generating layer 203 on both sides of the protection layer 205, and then a ring-type electrode is fitted on each end. Finally, the silver paste is hardened, thereby forming the electrodes 207.

The power consumption of the directly-heating roller constructed above is about 800W at it initial application, and it reaches a target operation temperature, for example, 180° C.–200° C. within 7–8 seconds. Therefore, because the directly heating roller of the invention can reached the fixing temperature rapidly, the power consumption during warming-up is low. Also, during a standby state, there is no need to apply an electrical power to the heating roller in the fixing portion of an electrophotographic device, thereby reducing the power consumption during standby.

6. Manufacturing Method

Figure 7:
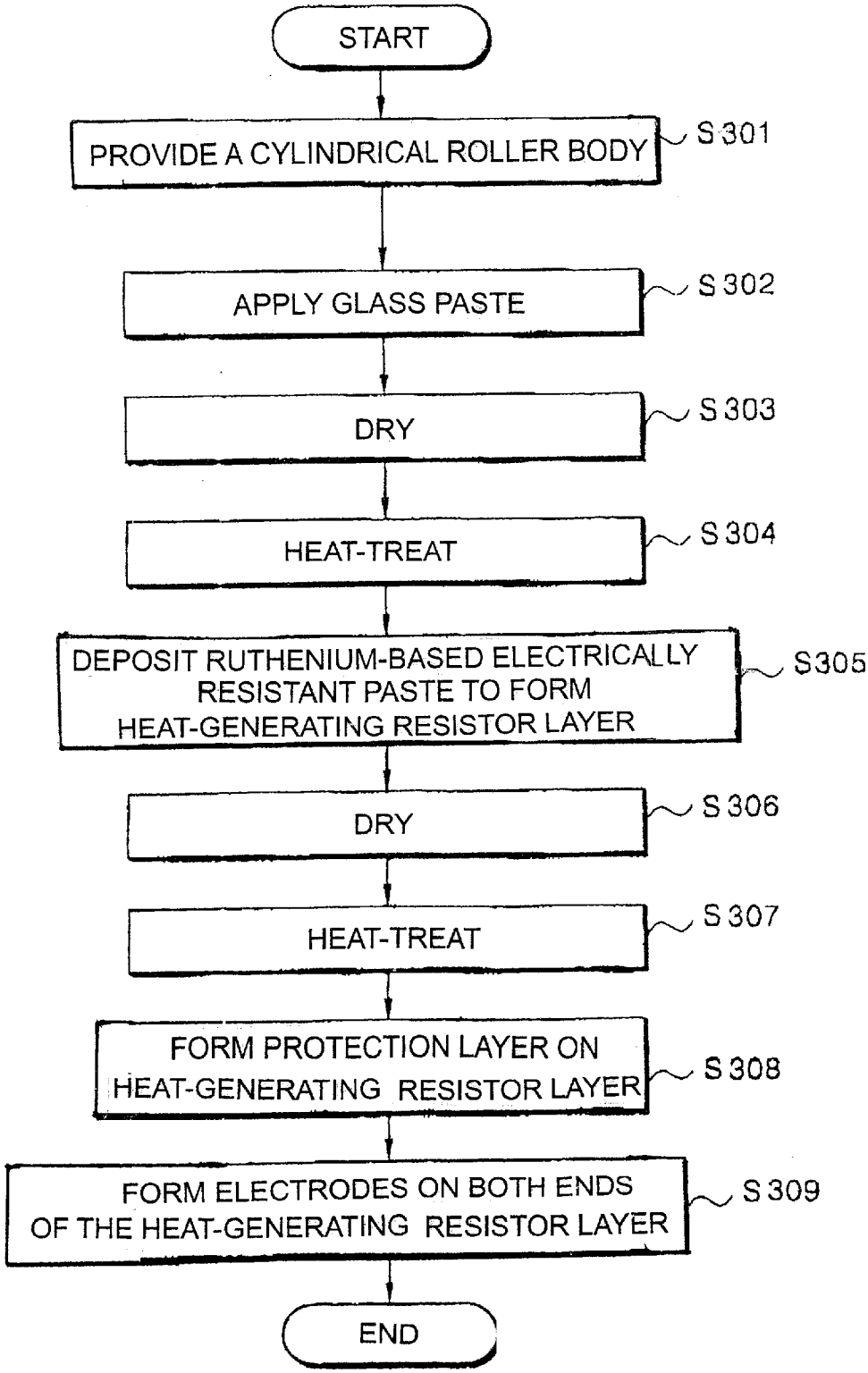
FIG. 7 is a flow chart showing a manufacturing method of the directly heating roller according to the an embodiment of the present invention.

FIG. 7 shows the procedure of a manufacturing method of a directly-heating roller according to the first compositional and process embodiment of the present invention, and FIGS. 8*a* through 8*e* show the manufacturing processes of the directly-heating roller according to this embodiment of the present invention.

Figure 8A:
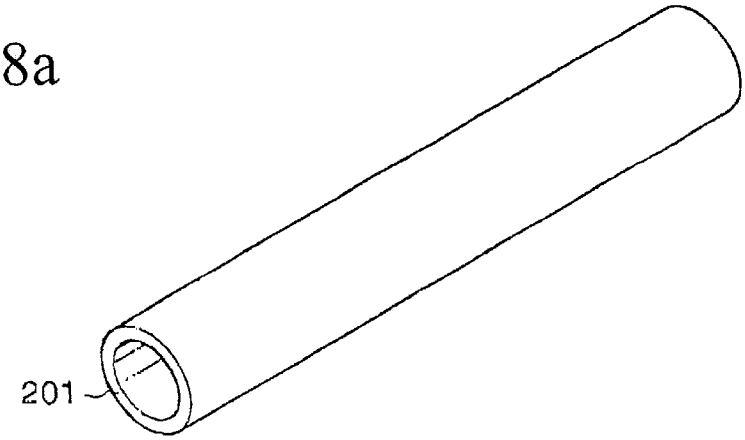
FIGS. 8*a* to FIG. 8*e* are perspective views showing a manufacturing processes of the directly heating roller according to an embodiment of the present invention.
Figure 8B:
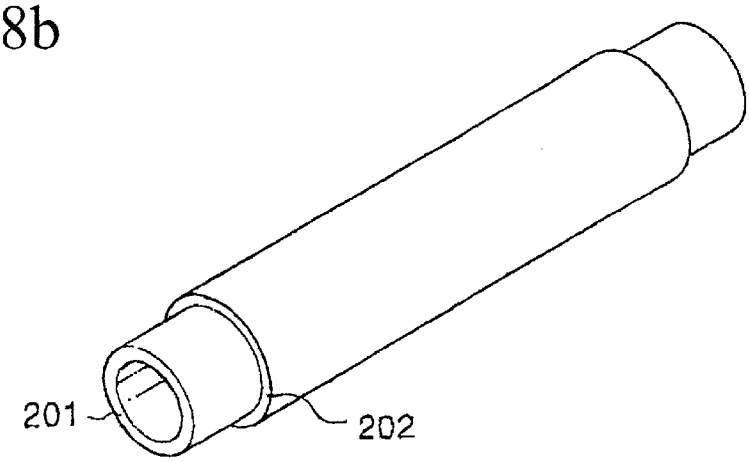

Referring to FIGS. 7 and 8*a* to 8*e*, a pipe or cylindrical roller body 201 is first formed by processing a metal material such as stainless steel (see FIG. 8*a*). The processed roller body 201 is cleaned using an ultrasonic wave in order to remove impurities. (step 301)

The insulating layer paste described above is deposited on the surface of the cleaned roller body 201 using a screen printing method. (step 302)

Figure 9A:
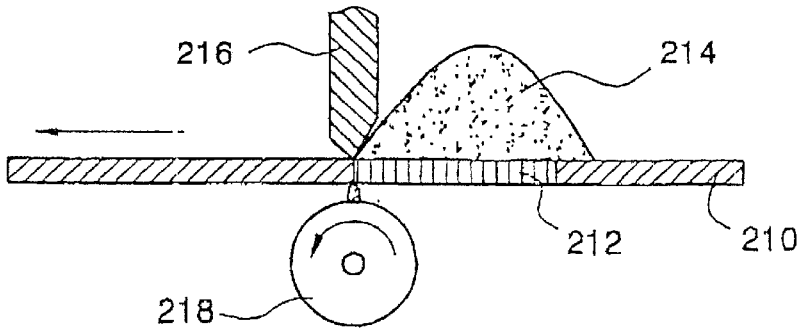
FIGS. 9*a* to 9*c* are cross sectional views illustrating a screen printing method of a paste according to an embodiment of the present invention.
Figure 9B:
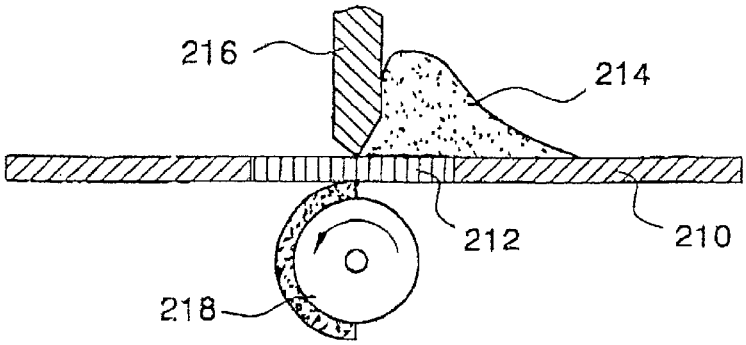
Figure 9C:
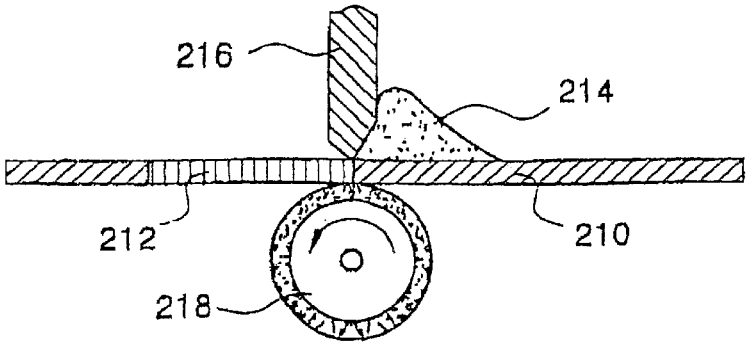

FIGS. 9*a* through 9*c* show a screen printing method according to this embodiment of the present invention. As shown in FIG. 9*a,* a mask 212 of a printed board 210 is covered with a paste 214. Thereafter, the roller body 218 fixed to a rotation axis is lifted up and thus contacted is to the bottom surface of the mask 212. A squeegee or blade 216 is lowered down and thus contacted to the front surface of the mask 212. By rotating the roller body 218 in a counter-clockwise direction (as shown in the Figure) while moving the printed board 210 toward the left, the paste 214 is pressed and the mask 212 is pushed downward, and therefore paste is squeezed through the meshes of a net of the mask 212. The paste squeezed downward from the mask 212 is coated on the rotating roller body 212. The thickness of the coated paste is determined by the size of the meshes of the net and the moving rate of the printed board. The width of the mask is formed to be equal to the circumference length of the roller body.

Alternative methods of applying the paste may also be used. For example, the paste may be applied by dipping or spraying methods.

The paste coated using the screen printing method (step 302) is dried during a predetermined time at a constant temperature and then is heat-treated (step 304). By depositing and drying the paste, the formation of a film can be prevented and the creation of cracks can be prevented. The deposition may be performed many times by the screen printing method to obtain a constant thickness, and the number of times and the deposition thickness can be varied by the design specification.

Figure 10:
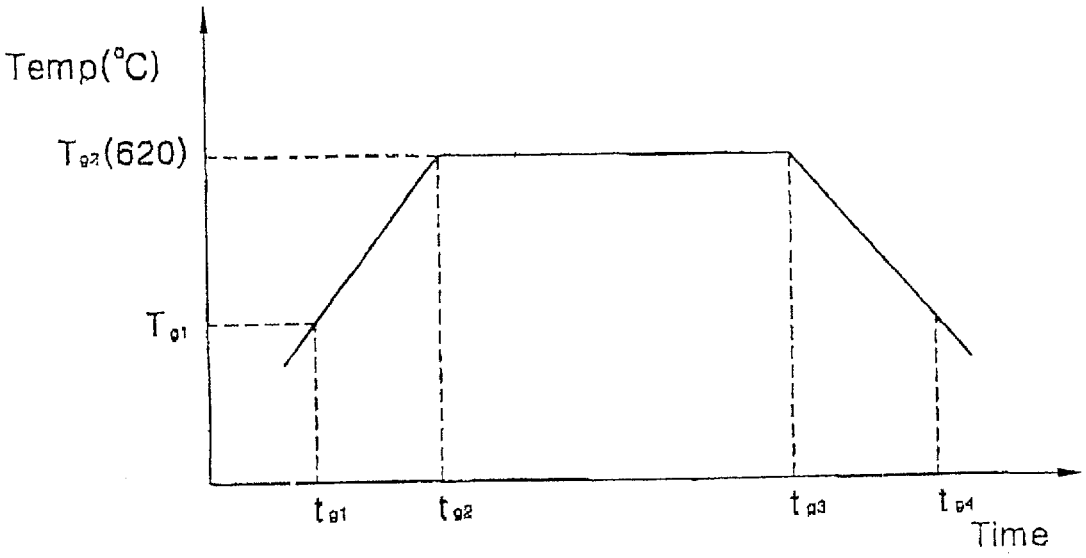
FIG. 10 is a graph showing a heating temperature cycle to form an insulating layer of an embodiment of the present invention.

FIG. 10*a* is a graph illustrating a relationship between a heating temperature and a heating time. The roller body coated with the insulating layer paste is placed into a sintering furnace, and then undergoes a heating process for about 45 minutes. As shown in FIG. 10, between the time interval tg1 and tg2, the temperature is increased slowly for about 15 minutes only to be about 620° C. Between the time interval tg2 and tg3, the temperature of 620° C. is maintained for about 10 or 15 minutes. Thereafter, between the time interval tg3 and tg4, the temperature is decreased slowly for about 15 minutes.

By repeating the printing and heating processes of at least once, the insulating layer 202 is adhered closely to the roller body 201 and is fixed on it, leading to the strong tolerance to external impact and the excellent temperature characteristics. In this embodiment of the present invention, a glass insulating layer 202 having a thickness of about 70 $\mu$m to about 120 $\mu$m is obtained (see FIG. 8*b*). The insulating layer is made of an insulating layer paste softened at a temperature higher than the softening point of a heat generating layer and the same temperature as the softening point of the heat generating layer. This is because if a reaction between a ruthenium compound prepared during heating the heat generating layer and a lead component diffusing from the insulating layer occurs even in the insulating layer, the insulating property of the insulating layer may be lowered.

Subsequently, as shown in FIGS. 9*a* through 9*c,* the ruthenium-based heat generating layer paste is deposited twice on the insulating layer 202 using the screen printing method (step 306). It is dried for about 5 or about 10 minutes at a temperature of about 80 to about 120° C. in an air heating furnace, an electric heater, an infrared ray furnace, or the like (step 307). A thickness of the dried film is about 23 micrometer. During the drying process described above, the film formation on the surface of the deposited paste and an occurrence of a crack are prevented.

Figure 8C:
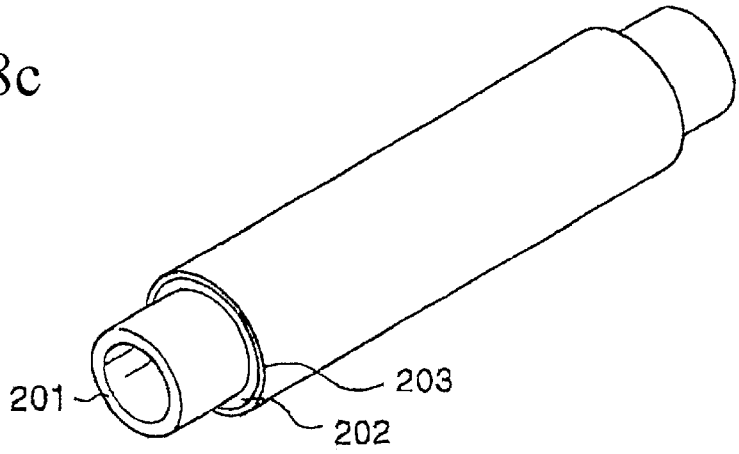

Then, as shown in FIG. 8*c,* by heating the deposited heat generating layer paste at a predetermined temperature, a heat generating layer is formed (step 308).

Figure 11:
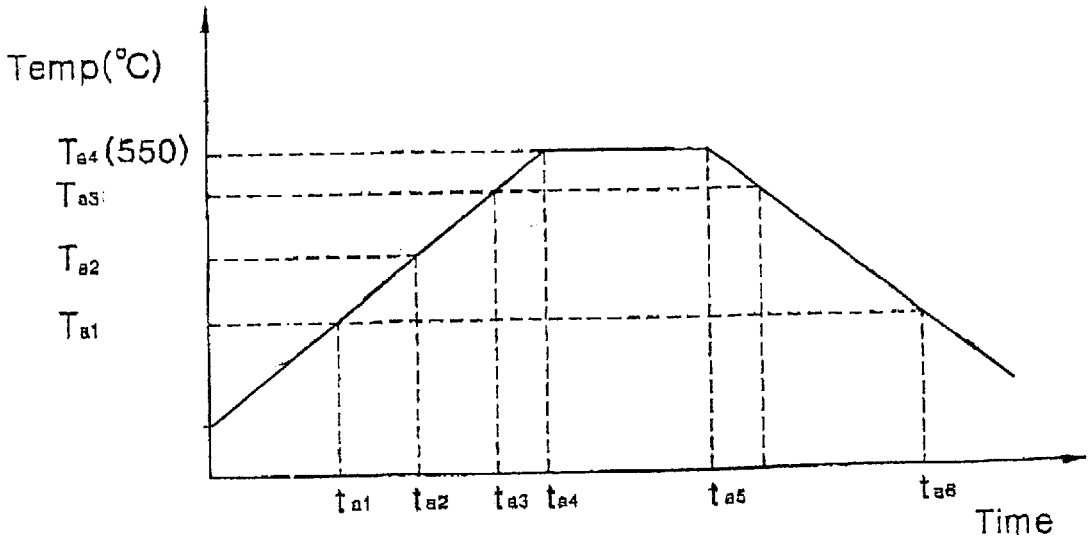
FIG. 11 is a graph showing a heating temperature cycle to form a heat generating layer of an embodiment of the present invention.
Figure 12A:
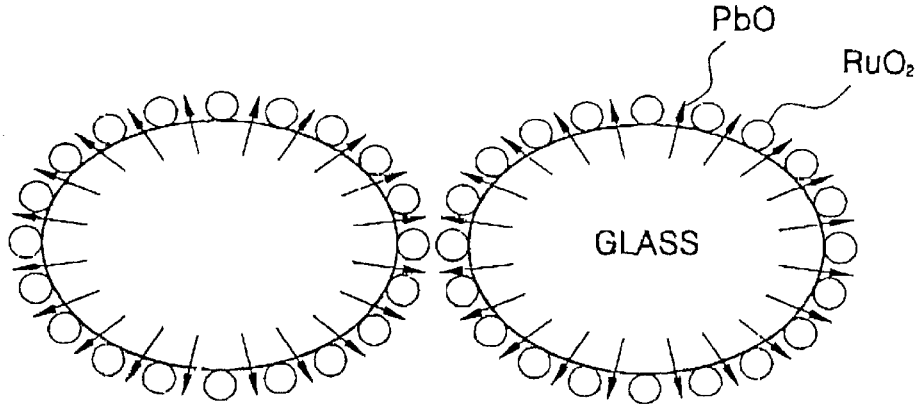
FIGS. 12*a* to FIG. 12*c* are views illustrating a mechanism of forming a heat generating layer according to an embodiment of the present invention.
Figure 12B:
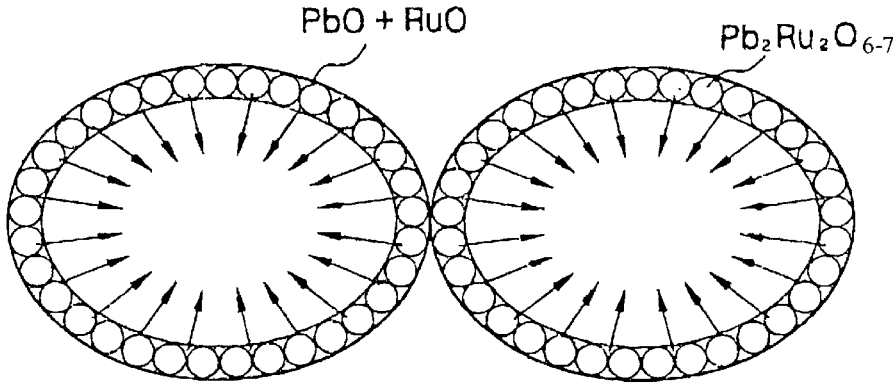
Figure 12C:
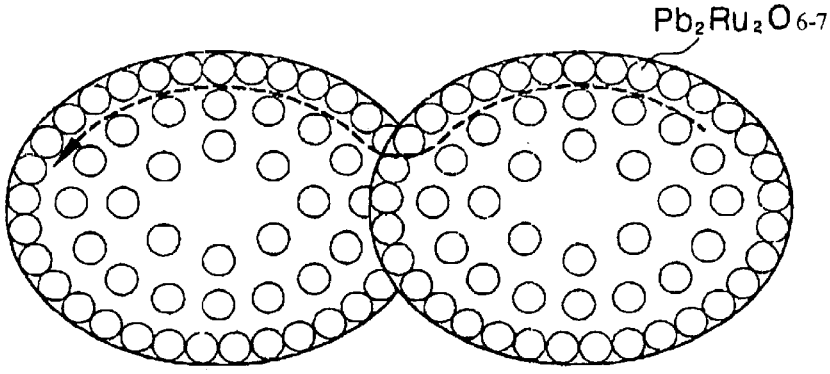

Hereinafter, the heating processes of an electric resistance heat generating material are described. FIG. 11 is a graph illustrating a relationship between heating temperature and heating time to form a heat generating layer paste according to this embodiment of the present invention. FIGS. 12*a* through 12*c* show a mechanism of forming an electric resistance heat generating layer according to the preferred embodiment of the present invention.

At first, a roller body coated with a heat generating layer paste is placed into a sintering furnace and is heated. When organic materials contained in the paste begin to be burnt while the heating temperature increases from Ta1 to Ta2 during the time interval between ta1 and ta2, some ruthenium oxide molecules stick to the surfaces of glass grains, and thus glass grains begin to be softened as shown in FIG. 12*a*.

When the heating temperature rises from Ta2 to Ta3 during the time interval between ta2 and ta3, glass grains begin to be further softened, and thus a part including a lead component begins to migrate to the surface of the grains. When the heating temperature rises from Ta3 to Ta4 during the time interval between ta3 and ta4, as shown in FIG. 12*b,* lead ions that are migrating from the softened glass grain react with ruthenium, thereby bring about a ruthenium oxide ($Pb_2Ru_2O_{6-7}$) of pyrochlore type on the surface of the glass grain. The reaction described above occurs over a range of times and temperature regions, and the above description of the reaction process is simplified for purposes of illustration. A combustion of organic material in the paste, and a reaction between the glass softened ruthenium and the lead component are gradually carried out.

If the heating temperature of Ta4 is maintained during the heating time between ta4 and ta5, as shown in FIG. 12*c,* the ruthenium oxide ($Pb_2Ru_2O_{6-7}$) of pyrochlore type formed on the surface spreads into the glass grains.

Stress of the sintered organization is relieved by an annealing process while the heating temperature decreases from Ta4 during the heating time between ta5 and tb6, and the organization becomes dense. In a typical process, then, the temperature will be ramped up from the ambient, or room temperature to the maximum temperature, Ta4. In one embodiment of the present invention, Ta4 is 550° C., which is below the temperature of 620° C. used in preparing the electrically insulating layer as shown in FIG. 10.

The temperature is held at the maximum temperature for a time period and then ramped down to room temperature. A typical heating time during the ramping up to maximum temperature is about 15 minutes. The time at the maximum temperature, (between ta4 and ta5 in the Figure) is typically less than 30 minutes, and may be approximately 10 minutes. The ramping down to room temperature is typically about 15 minutes. Therefore, the total heating time may be less than about 45 minutes. The exact heating times and temperatures characteristics can be further optimized for particular compositions.

Through such heating processes, particles are closely and densely attached to each other and become a stable organization having a constant mechanical strength, thereby forming a heat generating layer 203. As shown in FIG. 12*c,* electrical charges move through ruthenium oxide ($Pb_2Ru_2O_{6-7}$) of pyrochlore type. The heat generating resistor layer obtained has a thickness of about 5 micrometer and a sheet resistance of 12 about ohm/mm$^2$.

Figure 8D:
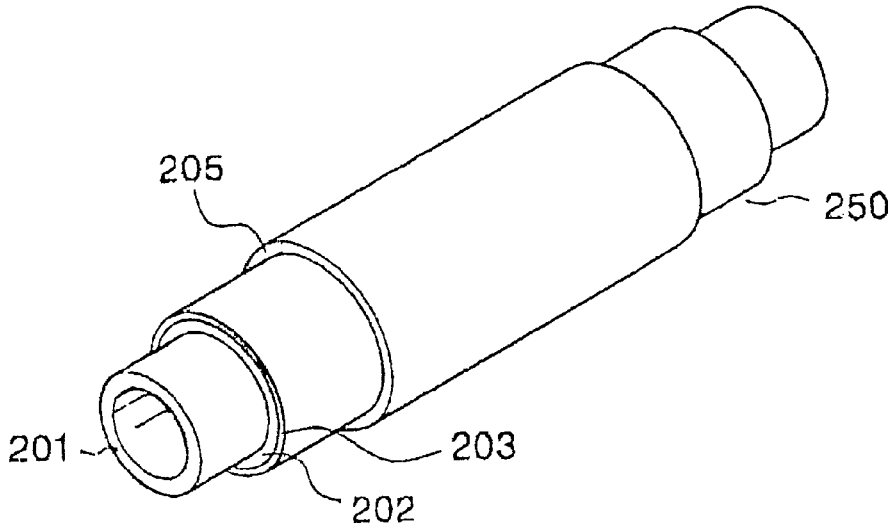

As shown in FIG. 8*d,* a protection layer 205 is made of tetrafluroethylene perfluoro alkylvinylether copolymer resin and has a thickness of about 50 micrometer in a tube shape. The heat generating resistor layer is fitted into the tube (step 309). When the protection layer is thermally annealed, it is shrunk and pressed. The protection layer 205 has a strong toner resistant property and insulates the heat generating resistor layer and also protects the heat generating resistance layer from the toner.

Figure 8E:
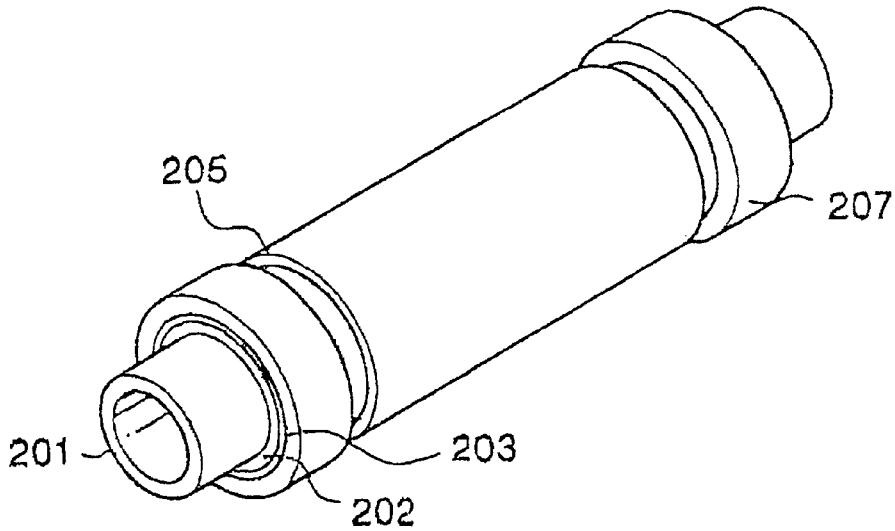

As shown in FIG. 8*e,* after depositing a silver paste on the heat generating resistor layer 203 on both sides of the protection layer 205 at regions 250, a ring-shaped copper electrode layer 207 is fitted and then the silver paste is hardened for about 30 minutes at a temperature of about 150° C. (step 310).

Figure 13:
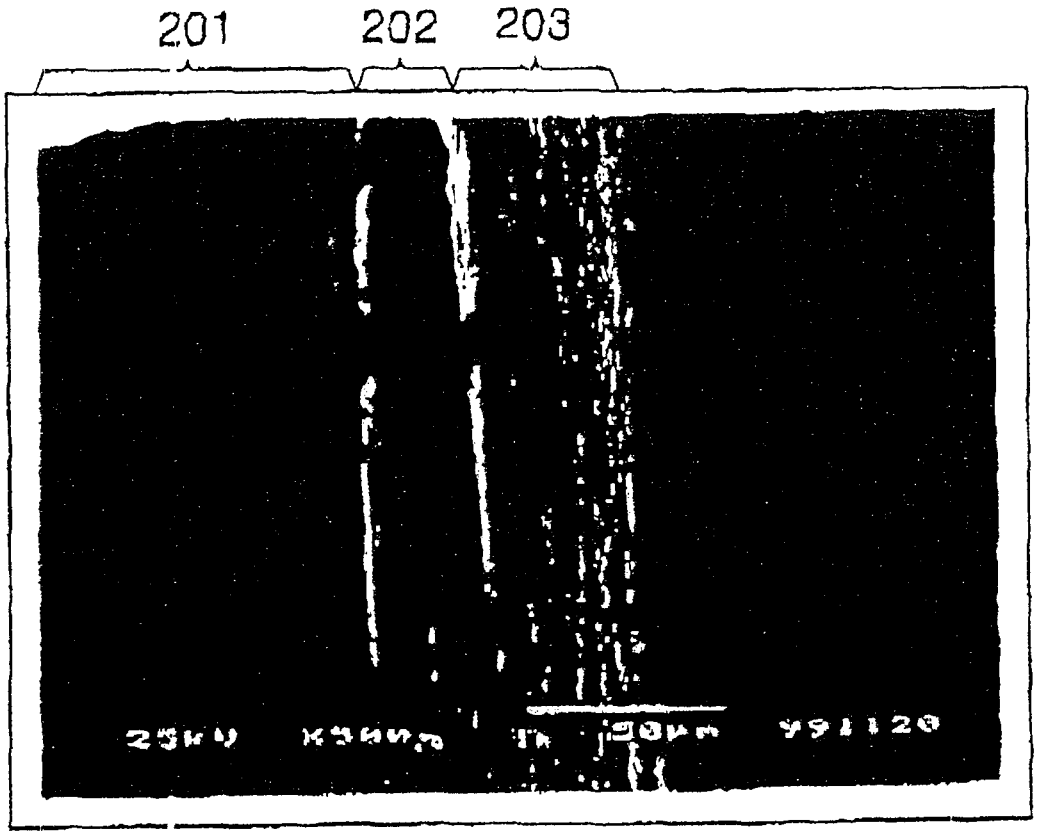
FIG. 13 is an electron microscopic photograph of a directly heating roller according to an embodiment of the present invention.

FIG. 13 is an electron microscopic photograph of a cross section of a directly heating roller according to the first material and process embodiment of the present invention. As shown in FIG. 13, since an insulating layer and a heat generating layer are formed on the roller body by a heating process and then are closely attached to the roller body, it has a very strong tolerance for the temperature characteristics and the external impact.

Second Material and Process Embodiment

1. Roller Body

In a second material and process embodiment of the present invention, in order to use a insulating layer paste and a heat generating layer paste of a high temperature, a roller body is made of a Ferrite-based stainless steel (SUS404 series) which can endure a high temperature with a critical elastic temperature of more than about 900° C.

2. Insulating Layer

In order to form an insulating layer, an insulating layer paste is deposited on the roller body 201 using a thick film deposition technology and then is heated at an critical elastic temperature of the roller body 201 is less than about 900° C. The thickness of the insulating layer is about 50–300 micrometer. The insulating layer may be made for example, of 3500N glaze available from Dupont corporation.

3. Heat Generating Layer

In order to form the heat generating layer, a heat generating paste including ruthenium-based compound is deposited on the insulating layer and then is heated at a second temperature that is less than a first temperature. Preferably, the heating temperature is below 850° C. A high temperature heating heat generating layer is made of 36xx-series compound available from Dupont corporation.

4. Protection Layer

Same as that of the first embodiment

5. Electrode

Same as that of the first embodiment

6. Manufacturing Process

At first, a pipe-shaped or cylindrical roller body is formed by processing a Ferrite-based stainless steel (SUS404). The processed roller body is cleaned using an ultrasonic wave to remove impurities. The insulating layer paste is deposited on the cleaned roller body using a screen printing method. After drying at a predetermined temperature during a predetermined time, the roller body is heat-treated. By depositing the paste and drying it, a film formation and an occurrence of a crack can be prevented. The depositing process of several times using the screen printing method is to obtain an uniform thickness, and the number of the depositing process that is carried out and a film thickness may be varied by a design purpose.

Figure 14:
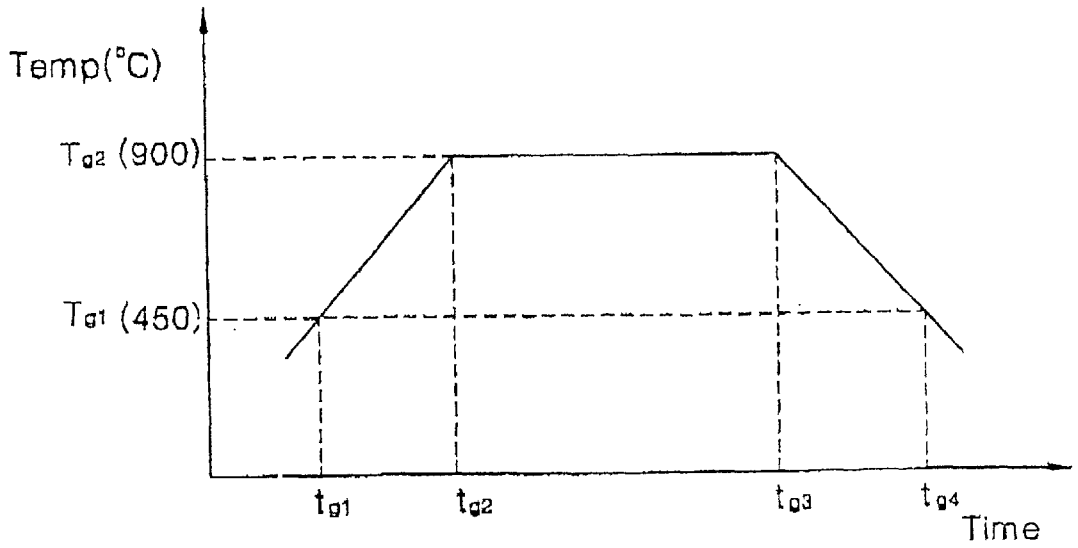
FIG. 14 is a graph showing a heating temperature cycle to form an insulating layer according to an embodiment of the present invention.

FIG. 14 is a graph illustrating a relationship between heating temperature and heating time for making an insulating layer, which shows a heating temperature characteristics of an insulating layer.

The roller body coated with the insulating layer paste is got into a sintering furnace during a heating time of about 45 minutes. Between the heating times tg1 and tg2, i.e., for about 15 minutes, the temperature is increased slowly until it reaches the heating temperature Tg2, i.e., about 900° C. Between the heating times tg2 and tg3, i.e., for about 10 or 15 minutes, the heating temperature of about 900° C. is maintained. Then, between the heating times tg3 and tg4, i.e., for about 15 minutes, the heating temperature decreases slowly.

By repeating the printing and heating processes for at least once, the insulating layer is adhered closely and is fixed on the roller body, leading to the strong tolerance to the external impact and good temperature characteristics. In the second preferred embodiment of the present invention, a glass insulating layer having a thickness of 70–120 micrometer is obtained. As the insulating layer, an insulating layer paste is used that is softened at a temperature higher than the softening point of a heat generating layer. This is because if a reaction between a ruthenium compound formed during heating the heat generating layer, and a lead component projected from the insulating layer occurs even in the insulating layer, the insulating property of the insulating layer is remarkably lowered.

Then, the ruthenium-based heat generating layer paste is twice deposited on the insulating layer using the screen printing method. Thereafter, it is dried at a temperature of about 80 to about 120° C. for about 5 or 10 minutes in an heating furnace, an electric heater, or an infrared ray furnace. A thickness of the dried film is about 23 $\mu$m. Such a dying process prevents a film formation on the deposited paste and an occurrence of a crack.

Figure 15:
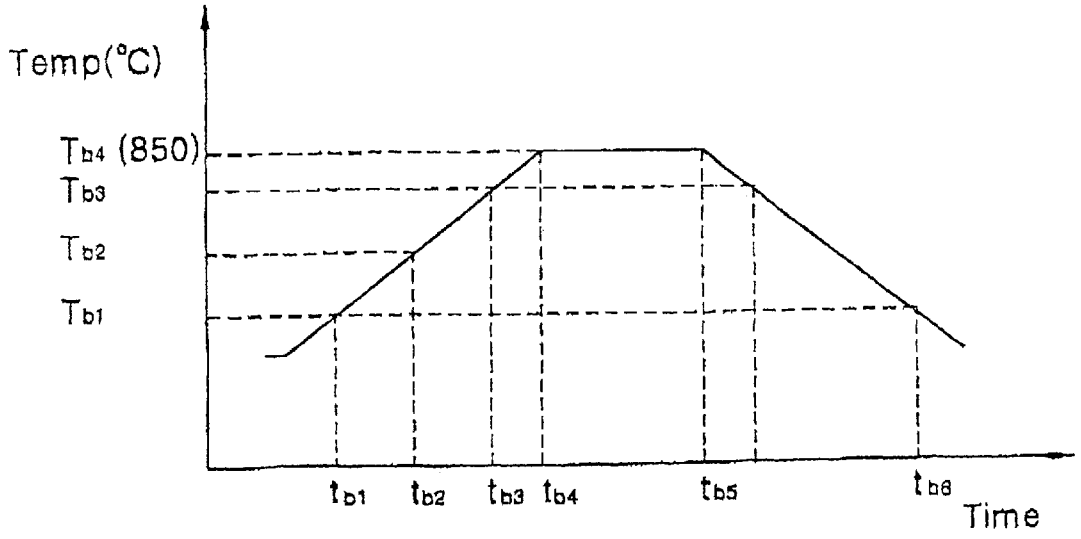
FIG. 15 is a graph showing a heating temperature cycle to form a heating layer according to an embodiment of the present invention.

Then, by heating the deposited heat generating layer paste at a predetermined temperature, a heat generating layer is formed. Hereinafter, the heating processes of an electric resistance heat generating material are described. FIG. 15 shows a heating temperature cycle to form a heat generating layer paste according to the preferred embodiment of the present invention.

At first, a roller body coated with a heat generating layer paste is placed into a sintering furnace and is heat-treated. When organic materials contained in the paste begin to burn while the heating temperature rises from Tb1 to Tb2 during the heating time between tb1 and tb2, ruthenium oxide sticks to the surroundings of glass grains and glass grains begin to become softened.

While the temperature rises from Tb2 to Tb3, i.e., from 500° C. to 700° C. during a time interval between tb2 and tb3, glass grains begin to be further softened, and a part including a lead component begins to be projected. While the temperature rises from Tb3 to Tb4, i.e., from 700° C. to 850° C. during a time interval between tb3 and tb4, the lead projected from the softened glass grain reacts with ruthenium and ruthenium oxide ($Pb_2Ru_2O_{6-7}$) of pyrochlore type begins to be created on the surface of the glass grain. These reactions, in actuality, do not occur only at these particular times and at temperatures, and the times and temperatures may vary. The graph divides the reaction process for purposes of illustration. Thus, combustion of the organic material and the reaction between the glass softened ruthenium and the lead component are gradually carried out.

If the heating temperature is maintained to be Tb4, i.e., 850° C. during the time interval between tb4 and tb5, ruthenium oxide ($Pb_2Ru_2O_{6-7}$) of pyrochlore type formed on the surface spreads into the glass grains.

As the stress of the sintered organization is relieved by an annealing process while the temperature decreases from Tb4, i.e., 850° C. during the time interval between tb5 and tb6, the organization becomes dense.

Typically, the heating time includes about 15 minutes during which the temperature is ramped to the maximum temperature, Tb4. The temperature is held at the maximum temperature during the time interval between tb4 and tb5 for typically less than 30 minutes, and may be held at the maximum temperature about 10 minutes. The temperature may be ramped down to room temperature during an interval of about 15 minutes. Therefore, the total heating time may be less than about 45 minutes. The heating temperature profile can be further optimized.

Through the heating processes, particles are closely and densely attached to each other and become a stable organization having a constant mechanical strength, thereby forming a heat generating layer.

Next, the protection layer and the electrode are proceeded by the same method as the first preferred embodiment of the present invention.

Second Structural Embodiment

Figure 16:
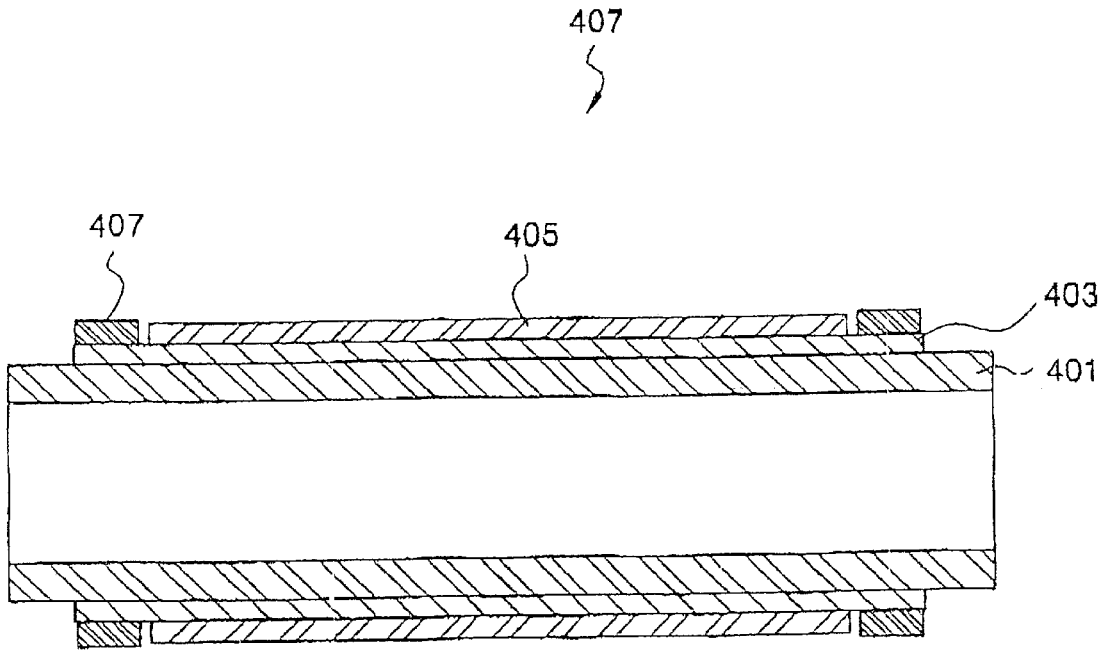
FIG. 16 is a cross-sectional view illustrating a directly heating roller of an electrophotographic image forming apparatus according to a second structural embodiment of the present invention.

FIG. 16 shows a configuration of a directly heating roller according to a second structural embodiment of the present invention. This embodiment of the present invention may be used for an electrically insulating roller body. A roller body 401 is made of a ceramic or a glass. The ceramic is weak to mechanical impact as compared to stainless steel, but can endure the high temperature annealing without deformation or variation of physical property. This allows pastes which can be heat-treated with a wide range of temperatures to be used. It is easy to select a composition of an electric resistance paste. Also, it is possible to widen the temperature condition of the heating process. Further, since ceramic is an insulating material, a heat generating layer can be formed directly on the outer surface of the roller body 401 without a process of forming an electrically insulating layer. The heating roller 413 includes an insulating cylindrical roller body 401, a heat generating resistor layer 403, a protection layer 405 and an electrode 407.

Figure 17:
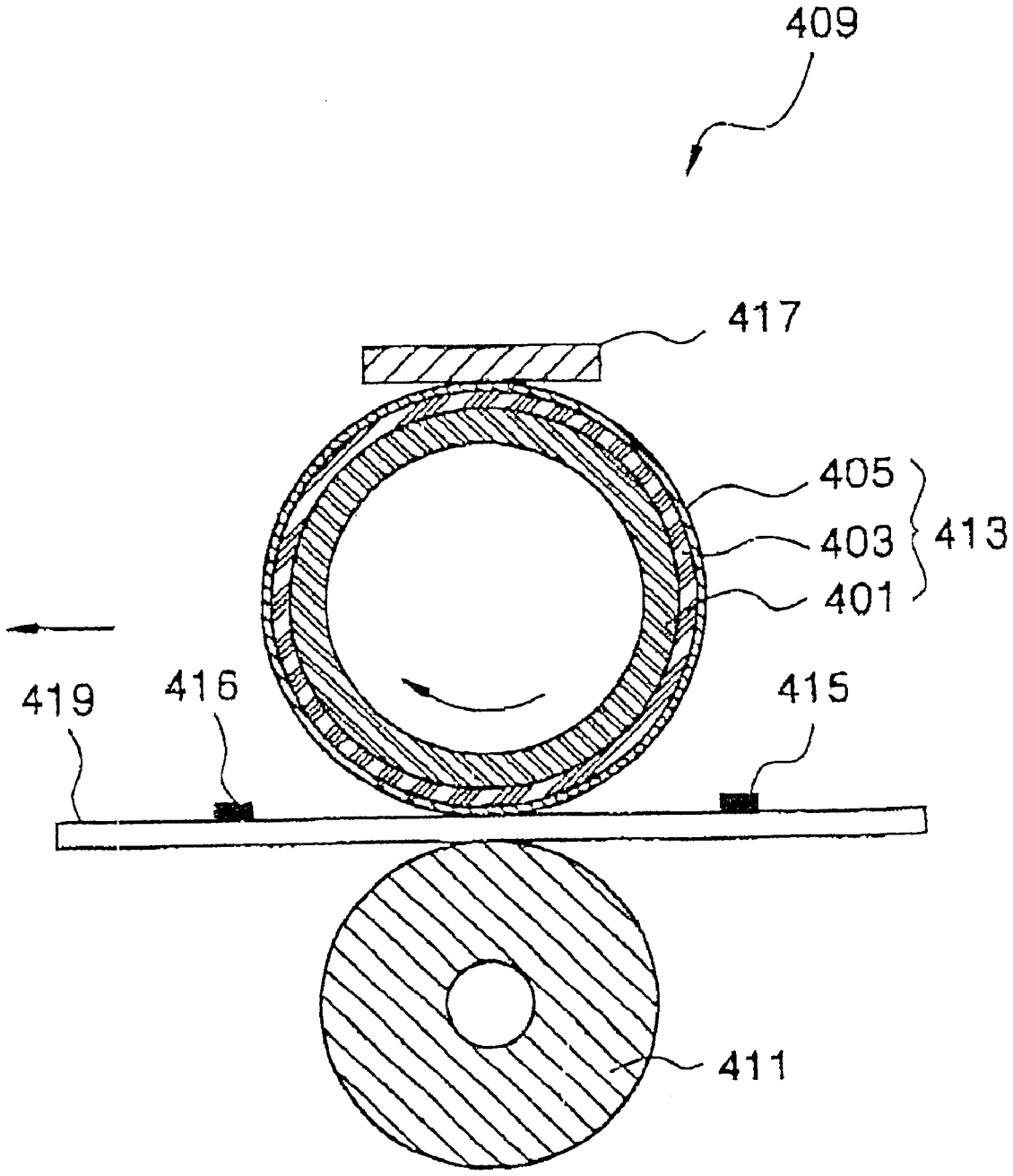
FIG. 17 is a cross-sectional view showing a fixing portion of the electrophotographic image forming apparatus according to an embodiment of the present invention.

FIG. 17 shows a fixing portion of an electrophotographic image forming apparatus that has a heating roller installed. In this embodiment of the present invention, a fixing portion 409 includes a heating roller 413 that rotates in a direction that a paper is withdrawn, i.e., in a counterclockwise direction as shown in the Figure, and a pressure roller 411 which rotates in a counterclockwise direction while contacting the heating roller 413. A thermistor 417 is arranged on the surface of the heating roller 413.

The temperature of the fixing portion 409 of the electrophotographic image forming apparatus increases due to resistance heat when an electrical current is supplied to a heat generating resistor layer 403 through an electrode 407. The surface temperature of the heating roller 413 is detected by the thermistor 417, and the amount of the electrical current supplied to the heat generating resistor layer 403 is controlled in response to the detected signal of the thermistor.

Unfixed toner image 415 on paper 419 is heated and pressed by the heating roller 413 and the pressure roller 411 and thus is fixed on the paper 419 as a stable toner image 416.

Third Material and Process Embodiment

A material and process embodiment of a heating roller according to the second structural embodiment of the present invention is as follows.

1. Roller Body

An insulating ceramic or glass having an elastic critical temperature above 600° C.

2. Heat Generating Layer, Protection Layer, Electrode

Same as those of the first material and process embodiment

3. Manufacturing Method

Figure 18:
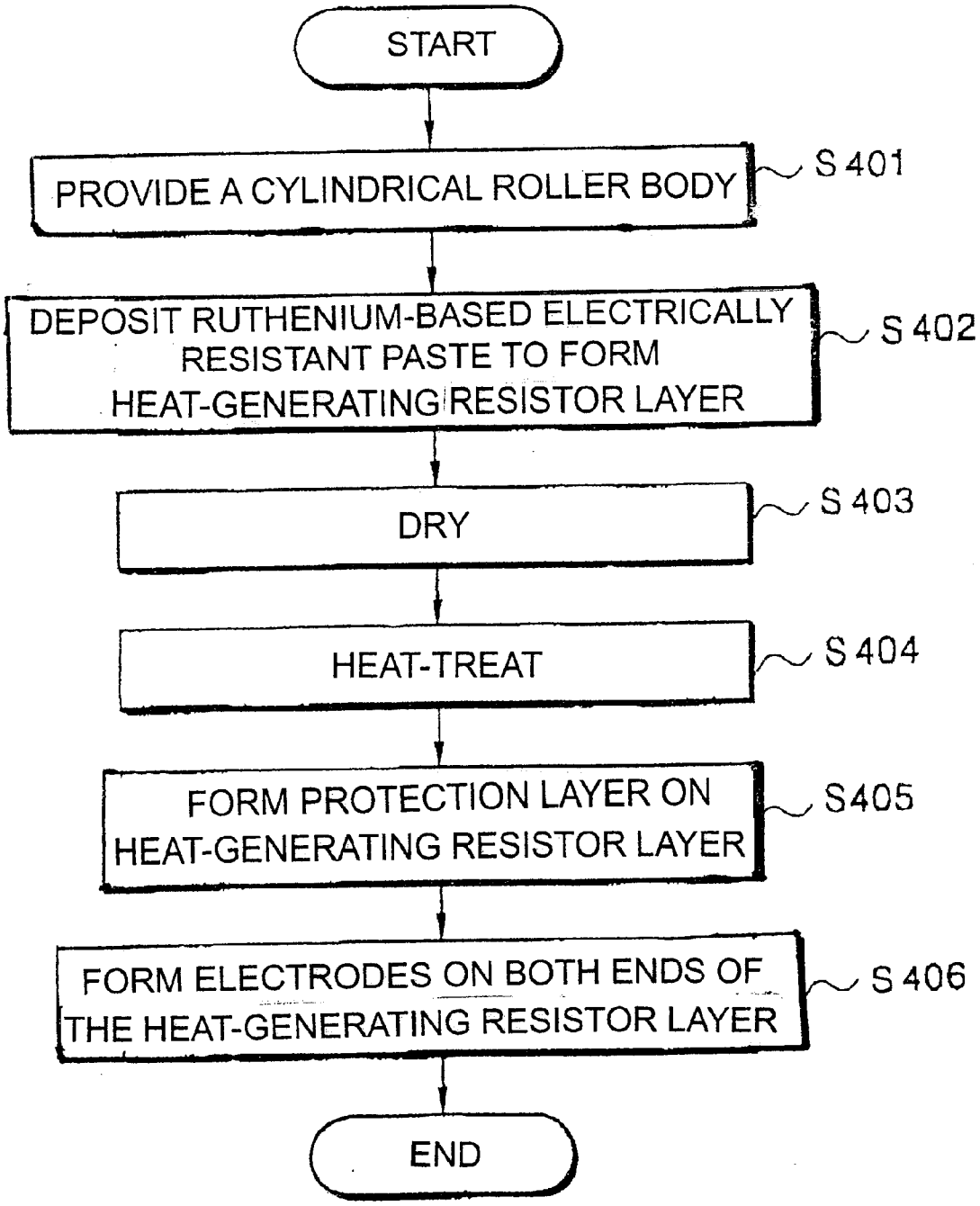
FIG. 18 is a flow chart showing a manufacturing method of a directly heating roller according to an embodiment of the present invention.

FIG. 18 shows a manufacturing method of a directly heating roller according to the third material and process embodiment of the present invention. FIGS. 19*a* through 19*d* show the manufacturing processes of the directly heating roller according to this embodiment of the present invention.

Figure 19A:
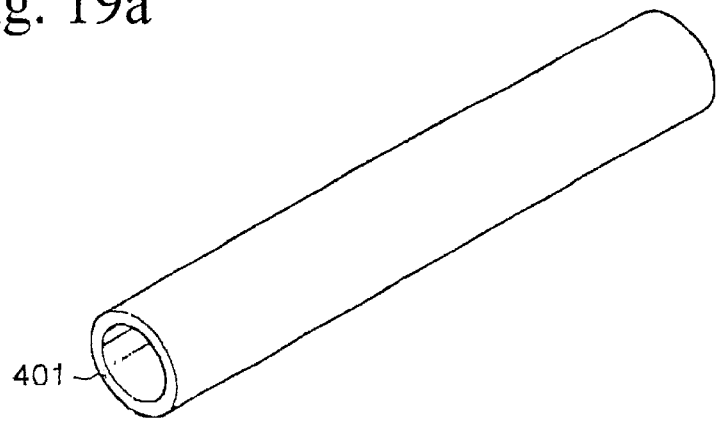
FIGS. 19*a* to FIG. 19*d* are perspective views showing a processes of manufacturing the directly heating roller according to an embodiment of the present invention.

Referring to Referring to FIG. 19*a,* the directly heating roller of the present invention forms a pipe or cylindrical roller body 401. The processed roller body is cleaned using ultrasonication to remove impurities (step 401).

The ruthenium-based heat generating layer paste according to the first preferred embodiment of the present invention is deposited at least once on the surface of the roller body 401 using the screen printing method as shown in FIGS. 9*a* through 9*c* (step 402). Thereafter, it is dried at a temperature of about 80 to about 120° C. in an air heating furnace, an electric heater, or an infrared ray furnace for about 5 or 10 minutes (step 403).

The dried heat generating layer film is heat-treated (step 308). The heating temperature cycle is the same as that of the heating process of the low temperature heat generating layer paste according to the first preferred embodiment of the present invention.

Figure 19B:
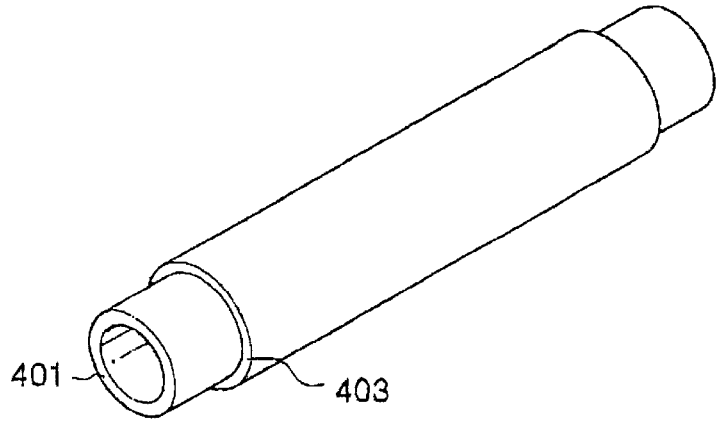

Through the heating process described above, particles are closely and densely attached to each other and become a stable organization having a constant mechanical strength, thereby forming and thus an electric resistance heat generating layer 403 as shown in FIG. 19*b*.

Figure 19C:
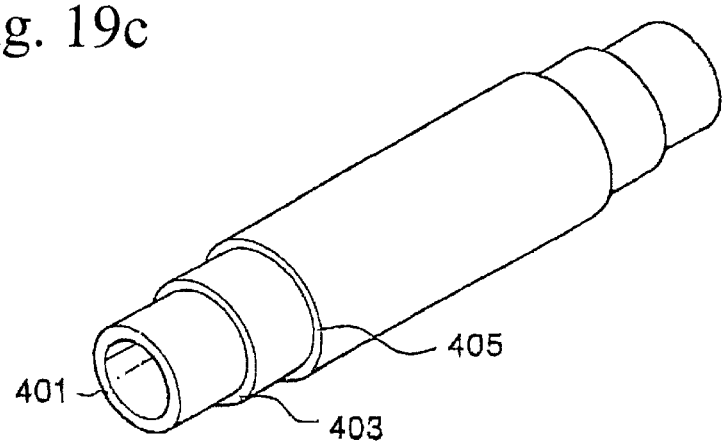

As shown in FIG. 19*c,* a protection layer 405 is made of tetrafluroethlene perfluoro alkylvinylether copolymer resin (PFA) and has a thickness of about 50 micrometer and a tube shape. The heat generating resistor layer 403 is fitted into the protection layer 405 (step 405). When the protection layer tube is thermally annealed as being inserted, the tube is shrunk and pressed.

Figure 19D:
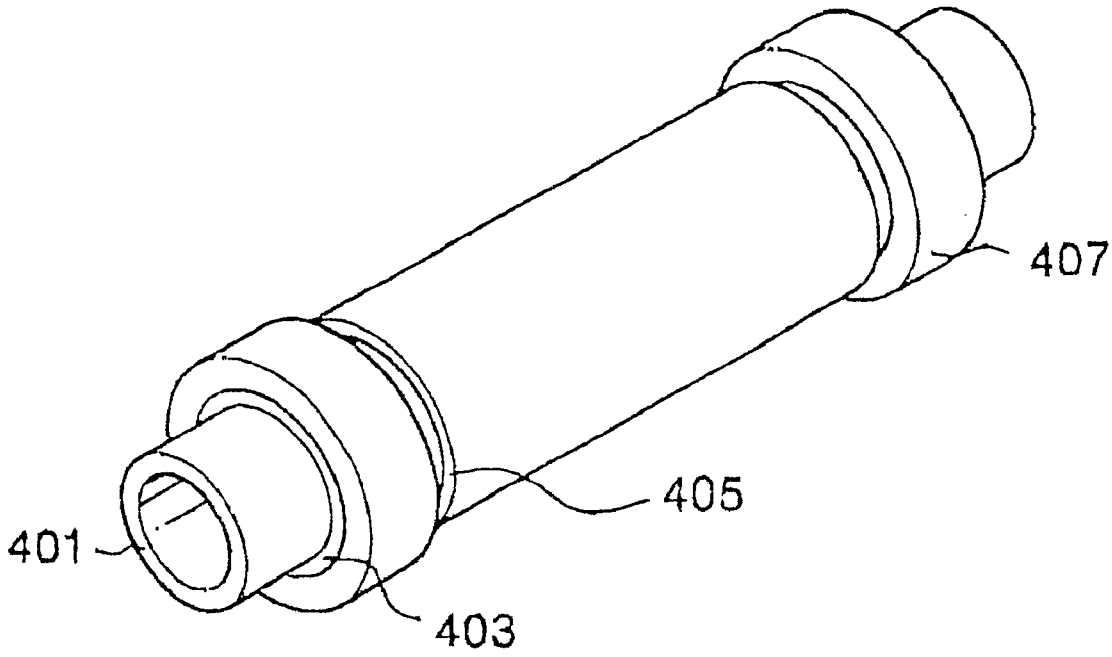

As shown in FIG. 19*d,* after depositing a silver paste on the surface of the heat generating resistor layer 403 on both sides of the protection layer 405, a ring-shaped copper electrode layers 407 are fitted and then the silver paste is hardened at a temperature of 150° C. for about 30 minutes (step 410).

Fourth Material and Process Embodiment

A fourth material and process embodiment in accord with the second structural embodiment will now be described.

1. Roller Body

An insulating ceramic or glass having an elastic critical temperature of more than 900° C.

2. Heat Generating Layer, Protection Layer, Electrode

Same as those of the second embodiment

3. Manufacturing Method

According to this embodiment of the present invention, a pipe or cylindrical roller body is formed. The processed roller body is cleaned by ultrasonication to remove impurities (step 401).

The ruthenium-based heat generating layer paste according the second material and process embodiment of the present invention is deposited at least once on the surface of the roller body using the screen printing method as shown in FIGS. 9*a* through 9*c*. Thereafter, it is dried at the temperature of about 80 to about 120° C. in an air heating furnace, an electric heater or an infrared ray furnace for about 5 or 10 minutes.

The dried heat generating layer film is heated (step 308). The heating temperature cycle is the same as that of the heating process of the high temperature heat generating layer paste according to the second preferred embodiment of the present invention. Through the heating process described above, particles are closely and densely attached to each other and become a stable organization having a constant mechanical strength, thereby forming an electric resistance heat generating layer.

The protection layer and the electrode are formed by the same method as that of the preferred embodiments described above.

As described herein before, according to the preferred embodiments of the present invention, it is possible to form a ruthenium-based heat generating layer on the surface of the roller and to make it to instantaneously reach a fixing temperature. As compared with the Ni—Cr based resistive heat generating material according to the conventional art, it is possible to generate a target fixing temperature faster using less electrical power. Also, in forming a ruthenium-based electric resistance heat generating layer, since a process can be carried out at a temperature as low as 550° C. and thus the range of materials which can be used for the roller body and the insulating layer is increased. Accordingly, manufacturing yields can be improved and less expensive materials can be selected to lower costs. Further, it is possible to manufacture a heat generating resistor layer having a uniform thickness. Furthermore, since it is possible to maintain the fixing temperature characteristics uniformly as a whole, and thus the toner fixing characteristics can be improved.

The directly heating roller of the present invention maybe incorporated into a fixing device of any of a number of kinds of electrophotographic device, such as printers, copiers, fax machines, etc. An electrophotographic device using the present invention would generally additionally have rotating members for conveying the sheets to be printed by the device along a paper path. The directly heating roller would be positioned on one side of the path, and a pressure roller would be positioned on the other side of the path for applying pressure to a sheet between the pressure roller and the directly heating roller.

While the invention has been particularly shown and described with reference to these embodiments thereof, it will be understood by those skilled in the art that the foregoing and other changes in form and details may be made therein without departing from the spirit and scope of the invention.

What is claimed is:

1. A heating roller, comprising:

a cylindrical roller body made of an electrically conductive material, said roller body having an outer surface;

an electrically insulating layer contacting the outer surface of the roller body;

a heat-generating resistor layer contacting the electrically insulating layer, said heat generating resistor layer comprising ruthenium and lead;

two electrodes contacting the heat-generating resistor layer, for providing electricity to the heat-generating resistor layer; and a protection layer contacting a portion of the heat-generating resistor layer, for protecting the outer surface of the heat-generating resistor layer.

2. The heating roller of claim 1, said heat-generating resistor layer comprising:

glass particles having surfaces, the surfaces of said glass particles comprising ruthenium.

3. The heating roller of claim 2, said glass particles further comprising lead.

4. The heating roller of claim 2, the surfaces of said glass particles comprising a compound of formula $Pb_2Ru_2O_{6-x}$, where x is a number between 0 and 6.

5. The heating roller of claim 1, said heat generating layer further comprising silver.

6. The heating roller of claim 1, the resistance between said two electrodes being in the range of 5 to 25 Ω.

7. The heating roller of claim 1, said cylindrical roller body being hollow with a wall thickness in the range of 0.5 to 3 mm.

8. The heating roller of claim 1, said electrically insulating layer having a thickness in the range of 50 μm to 500 μm.

9. The heating roller of claim 1, said heat generating resistor layer having a thickness in the range of 3 to 100 μm.

10. The heating roller of claim 1, said protection layer comprising a polymer selected from polytetrafluoroethylene, polyperfluoroalkylvinyl ether resin, and tetrafluoroethylene perfluoroalkylvinyl ether copolymer resin.

11. The heating roller of claim 1, said electrically insulating layer having multiple sublayers formed by multiple firings of a material applied to the roller body.

12. A heating roller, said heating roller comprising:

a cylindrical roller body having an outer cylindrical surface;

a heat-generating resistor layer formed around the outer cylindrical surface of the roller body, said heat-generating layer comprising ruthenium and lead; and two electrodes contacting the heat-generating resistor layer, for providing electricity to the heat-generating resistor layer.

13. The heating roller of claim 12, wherein the heat-generating layer includes a Ag component.

14. The heating roller of claim 12, said heat-generating resistor layer being formed at a temperature not exceeding the elastic critical temperature of the roller body.

15. The heating roller of claim 12, said roller body being formed of an austenite-based stainless steel.

16. The heating roller of claim 12, further comprising an electrically insulating layer around the outer cylindrical surface of the roller body between the roller body and the heat-generating resistor layer.

17. The heating roller of claim 14, said heat-generating resistor layer being formed at a temperature not exceeding 700° C.

18. The heating roller of claim 17, said heat-generating resistor layer being formed at a temperature not exceeding 600° C.

19. The heating roller of claim 17, said heat-generating resistor layer being formed at a temperature not exceeding 550° C.

20. The heating roller of claim 12, said heat-generating resistor layer being formed by heat-treatment of a paste, said paste comprising:

a first glass frit;

a powdered ruthenium compound;

a powdered silver compound;

an organic binder; and an organic solvent.

21. The heating roller of claim 20, said ruthenium compound being selected from $RuO_2$, $GdBiRu_2O_{6-7}$, $Co_2Ru_2O_6$, $PbBiRu_2O_{6-7}$, $Cu_xBi_{2-x}Ru_2O_{6-7}$ where $0<x<1$, and $Bi_2Ru_2O_{6-7}$.

22. The heating roller of claim 20, the average particle diameter of said powdered ruthenium compound being in the range of 0.01 to 0.1 μm.

23. The heating roller of claim 22, the average particle diameter of said powdered ruthenium compound being in the range of 0.02 to 0.08 μm.

24. The heating roller of claim 20, said silver compound being selected from metallic silver, silver oxide, AgPd and $Ag_{0.1}Pd_{0.9}RhO_2$.

25. The heating roller of claim 24, the average particle diameter of said powdered silver compound being in the range of 0.1 to 3 μm.

26. The heating roller of claim 25, the average particle diameter of said powdered silver compound being in the range of 0.1 to 3 μm with a maximum particle diameter of 7 μm.

27. The heating roller of claim 20, the surface area to weight ratio of the powdered silver compound being in the range of about 0.5 to 3.5 $m^2/g$.

28. The heating roller of claim 20, said organic binder being selected from ethylcellulose, methylcellulose, nitrocellulose, carboxymethyl cellulose, an acrylic ester, a methacrylic ester, polyvinyl alcohol, and polyvinyl butryal.

29. The heating roller of claim 20, said solvent being selected from texanol, ethyleneglycol(terpene), diethyleneglycol monobutyl ether, isopropylbenzene, methylethyl ketone, dioxane, acetone, cyclohexanone, cyclopentanone, isobutylalcohol, dimethylsulfoxide, terpineol, pine oil, polyvinylbutyral, 3-methoxybutyl acetate, γ-butyrolactone, and diethylphthalate.

30. The heating roller of claim 20, said glass particles being characterized in having a softening point between 400 and 550° C.

31. The heating roller of claim 20, said paste further comprising a second glass frit of different composition from said first glass frit.

32. The heating roller of claim 31, said first glass frit comprising bismuth, silicon, boron, titanium and aluminum and said second glass frit comprising lead, silicon, boron, titanium and aluminum.

33. The heating roller of claim 31, said first glass frit comprising 40 to 90 wt % $Bi_2O_3$, 5 to 30 wt % $SiO_2$, 5 to 30 wt % $B_2O_3$, and 2 to 40 wt % BaO and said second glass frit comprising 40 to 90 wt % PbO, 10 to 40 wt % $SiO_2$, 5 to 30 wt % $B_2O_3$, less than 10% $TiO_2$ and less than 20% $Al_2O_3$.

34. The heating roller of claim 20, said first glass frit comprising 40 to 90 wt % $Bi_2O_3$, 40 to 90 wt % PbO, 5to 30 wt % $SiO_2$, 5 to 30 wt % $B_2O_3$, and 2 to 40 wt % BaO, less than 10 wt % $TiO_2$ and less than 20% $Al_2O_3$.

35. The heating roller of claim 20, said paste being applied around the circumferential surface of the roller body by a screening process before heat-treatment.

36. The heating roller of claim 16, said electrically insulating layer having multiple sublayers formed by multiple firings of a material applied to the roller body.

37. The heating roller of claim 16, said electrically insulating layer being formed by formed by heat-treatment of a paste, said paste comprising:

a glass frit comprising lead, silicon, and boron;

an organic binder; and an organic solvent.

38. The heating roller of claim 20, said paste comprising $RbRuO_6$, $RuO_2$, and Ag.

39. The heating roller of claim 38, said glass frit being formed from $Bi_2O_3$, $SiO_2$, $B_2O_3$, BaO and $Al_2O_3$.

40. A method of making a heating roller, comprising the steps of:

applying a paste to a portion of the circumferential surface of a cylindrical roller body, said paste comprising:

a first glass frit;

a powdered ruthenium compound;

a powdered silver compound;

an organic binder; and an organic solvent; and heat-treating the paste to form a heat-generating resistor layer around the cylindrical roller body.

41. The method of claim 40, said ruthenium compound being selected from $RuO_2$, $GdBiRu_2O_{6-7}$, $Co_2Ru_2O_6$, $PbBiRu_2O_{6-7}$, $Cu_xBi_{2-x}Ru_2O_{6-7}$ where $0<x<1$, and $Bi_2Ru_2O_{6-7}$.

42. The method of claim 40, the average particle diameter of said powdered ruthenium compound being in the range of 0.01 to 0.1 μm.

43. The method of claim 42, the average particle diameter of said powdered ruthenium compound being in the range of 0.02 to 0.08 μm.

44. The method of claim 40, said silver compound being selected from metallic silver, silver oxide, AgPd and $Ag_{0.1}Pd_{0.9}RhO_2$.

45. The method of claim 44, the average particle diameter of said powdered silver compound being in the range of 0.1 to 3 μm.

46. The method of claim 45, the average particle diameter of said powdered silver compound being in the range of 0.1 to 3 μm with a maximum particle diameter of 7 μm.

47. The method of claim 40, the surface area to weight ratio of the powdered silver compound being in the range of about 0.5 to 3.5 $m^2/g$.

48. The method of claim 40, said organic binder being selected from ethylcellulose, methylcellulose, nitrocellulose, carboxymethyl cellulose, an acrylic ester, a methacrylic ester, polyvinyl alcohol, and polyvinyl butryal.

49. The method of claim 40, said solvent being selected from texanol, ethyleneglycol(terpene), diethyleneglycol monobutyl ether, isopropylbenzene, methylethyl ketone, dioxane, acetone, cyclohexanone, cyclopentanone, isobutylalcohol, dimethylsulfoxide, terpineol, pine oil, polyvinylbutyral, 3-methoxybutyl acetate, γ-butyrolactone, and diethylphthalate.

50. The method of claim 40, said glass particles being characterized in having a softening point between 400 and 550° C.

51. The method of claim 40, said paste further comprising a second glass frit of different composition from said first glass frit.

52. The method of claim 51, said first glass frit comprising bismuth, silicon, boron, titanium and aluminum and said second glass frit comprising lead, silicon, boron, titanium and aluminum.

53. The method of claim 51, said first glass frit comprising 40 to 90 wt % $Bi_2O_3$, 5 to 30 wt % $SiO_2$, 5 to 30 wt % $B_2O_3$, and 2 to 40 wt % BaO and said second glass frit comprising 40 to 90 wt % PbO, 10 to 40 wt % $SiO_2$, 5 to 30 wt % $B_2O_3$, less than 10% $TiO_2$ and less than 20% $Al_2O_3$.

54. The device of claim 40, said first glass frit comprising 40 to 90 wt % $Bi_2O_3$, 40 to 90 wt % PbO, 5 to 30 wt % $SiO_2$, 5 to 30 wt % $B_2O_3$, and 2 to 40 wt % BaO, less than 10 wt % $TiO_2$ and less than 20% $Al_2O_3$.

55. The method of claim 40, the temperature of the paste not exceeding the elastic critical temperature of the roller body during said heat-treating step.

56. The method of claim 40, the temperature of the paste not exceeding 700° C. during said heat-treating step.

57. The method of claim 56, the temperature of the paste not exceeding 600° C. during said heat-treating step.

58. The method of claim 57, the temperature of the paste not exceeding 550° C. during said heat-treating step.

59. The method of claim 40, said heat-treating step comprising:

ramping the temperature of the applied paste from room temperature up to a maximum temperature value; then maintaining the temperature at the maximum temperature value for a time period; and then ramping the temperature down to room temperature.

60. The method of claim 59, said time period at the maximum temperature being less than 30 minutes.

61. The method of claim 60, said time period at the maximum temperature being approximately 10 minutes.

62. The method of claim 59, said maximum temperature value being less than 700° C.

63. The method of claim 62 said maximum temperature value being less than 600° C.

64. The method of claim 63, said maximum temperature value being approximately 550° C.

65. The method of claim 40, said paste being applied by one of a screening method, dipping or spraying.

66. The method of claim 40, further comprising the step of:

attaching two circumferential electrodes to the heat-generating resistor layer toward opposite ends of the heat-generating resistor layer.

67. The method of claim 40, further comprising the step of:

heat shrinking a polymer tube over the heat-generating resistor layer to form a protection layer.

68. The method of claim 40, further comprising the step of:

spraying a polymer over the heat-generating resistor layer to form a protection layer.

69. The method of claim 67, further comprising the step of:

applying a primer layer to the heat-generating resistor layer before heat-shrinking the polymer tube to form the protection layer.

70. The method of claim 68, further comprising:

applying a primer layer to the heat-generating resistor layer before spraying the polymer to form the protection layer.

71. A method of making a heating roller, comprising the steps of:

forming an electrically insulating layer around the circumferential surface of an electrically conductive cylindrical roller body;

applying a first paste to a portion of the formed electrically insulating layer, said first paste comprising:

a first glass frit;

a powdered ruthenium compound;

a powdered silver compound;

an first organic binder; and a first organic solvent; and heat-treating the first paste to form a heat-generating resistor layer on the electrically insulating layer.

72. The method of claim 71, said roller body being formed of an austenite-based stainless steel.

73. The method of claim 71, the maximum temperature reached during the forming the electrically insulating layer not exceeding the elastic critical temperature of the roller body.

74. The method of claim 72, the maximum temperature reached during the forming the electrically insulating layer not exceeding the elastic critical temperature of the roller body.

75. The method of claim 73, the temperature not exceeding 700° C. during said step of forming the electrically insulating layer.

76. The method of claim 75, the temperature not exceeding 630° C. during said step of forming the electrically insulating layer.

77. The method of claim 71, said step of forming the electrically insulating layer comprising:

applying a second paste to the roller body, said second paste comprising:

a second glass frit comprising lead, silicon and boron;

a second organic binder;

a second organic solvent; and heat-treating the second paste to form an electrically insulating layer.

78. The method of claim 77, further comprising:

repeating the steps of applying the second paste and heat-treating the second paste to form multiple sublayers of the electrically insulating layer.

79. The method of claim 73, the maximum temperature reached during said heat-treating of the first paste not exceeding the maximum temperature reached during the forming of the electrically insulating layer.

80. The method of claim 79, the maximum temperature reached during the forming of the electrically insulating layer not exceeding 700° C.

81. The method of claim 79, the maximum temperature reached during the forming of the electrically insulating layer not exceeding 630° C.

82. The method of claim 80, the maximum temperature reached during said heat-treating of the first paste not exceeding 600° C.

83. The method of claim 81, the maximum temperature reached during said heat-treating of the first paste not exceeding 550° C.

84. An electrophotographic device, comprising the heating roller of claim 1, and further comprising:

a plurality of rotating members providing a path of conveyance for sheets of a printable medium traveling trough said device;

said heating roller being positioned on a first side of said path; and a pressure roller tangentially aligned with said exterior circumferential surface while positioned on a second side of said path diametrically opposite from said heating roller.

85. An electrophotographic device, comprising the heating roller of claim 12, and further comprising:

a plurality of rotating members providing a path of conveyance for sheets of a printable medium traveling trough said device;

said heating roller being positioned on a first side of said path; and a pressure roller tangentially aligned with said exterior circumferential surface while positioned on a second side of said path diametrically opposite from said heating roller.

86. A process of making a heating roller, comprising:

preparing a cylindrical roller having an exterior circumferential surface;

applying to said exterior circumferential surface a paste comprised of:

a glass frit, a powdered ruthenium compound, a powdered silver compound, an organic binder, and an organic solvent, to entirely coat a central cylindrical portion of said exterior circumferential surface; and heat treating said paste to form a heat generating resistor layer surrounding said central cylindrical portion.

87. The process of claim 86, further comprised of performing said heat treating at a temperature of about 550° C. and not exceeding 570° C.

88. A process of making a heating roller, comprising:

preparing a cylindrical roller made of an electrically conducting material having an exterior circumferential surface made of said material;

coating a central circumferential portion of said exterior surface of said material with an electrically insulating substance;

applying to said central circumferential portion a paste comprised of:

a glass frit, a powdered ruthenium compound, a powdered silver compound, an organic binder, and an organic solvent, to form a coating of said paste around said central circumferential portion; and heating said paste to form a heat generating resistor surrounding said central circumferential portion.

89. The process of claim 88, further comprised of performing said heat treating at a temperature of about 550° C. and not exceeding 570° C.

90. A process of making a heating roller, comprising:

preparing a cylindrical roller made of an electrically conducting material having an exterior circumferential surface made of said material;

applying to a central circumferential portion of said exterior surface of said material, an electrically insulating substance;

heat treating said electrically insulating substance at a first temperature;

applying to said central circumferential portion a paste comprised of:

a glass frit, a powdered ruthenium compound, a powdered silver compound, an organic binder, and an organic solvent, to form a coating of said paste around said central circumferential portion; and heat treating said paste at a second temperature not exceeding said first temperature to form a heat generating resistor surrounding said central circumferential portion.

91. The process of claim 90, further comprised of performing said heat treating of said paste at a temperature of about 550° C. and not exceeding 570° C.

92. The process of claim 90, further comprised of:

performing said heat treating of said electrically insulating substance at a temperature not exceeding 630° C.; and performing said heat treating of said paste at a temperature of about 550° C. and not exceeding 570° C.

* * * * *